US011837160B2

(12) United States Patent
Huang et al.

(10) Patent No.: US 11,837,160 B2
(45) Date of Patent: Dec. 5, 2023

(54) DISPLAY PANEL AND DRIVING METHOD THEREOF, ARRAY SUBSTRATE, DISPLAY PANEL, AND DISPLAY DEVICE

(71) Applicant: Wuhan Tianma Microelectronics Co., Ltd., Wuhan (CN)

(72) Inventors: Wei Huang, Wuhan (CN); Qinyuan Zhang, Wuhan (CN); Yangzhao Ma, Wuhan (CN)

(73) Assignee: Wuhan Tianma Microelectronics Co., Ltd., Wuhan (CN)

( * ) Notice: Subject to any disclaimer, the term of this patent is extended or adjusted under 35 U.S.C. 154(b) by 0 days.

(21) Appl. No.: 18/091,903

(22) Filed: Dec. 30, 2022

(65) Prior Publication Data

US 2023/0146078 A1 May 11, 2023

(30) Foreign Application Priority Data

Sep. 21, 2022 (CN) ..... 202211153729.3

(51) Int. Cl.
*G09G 3/32* (2016.01)

(52) U.S. Cl.
CPC ..... *G09G 3/32* (2013.01); *G09G 2300/0842* (2013.01); *G09G 2310/0216* (2013.01); *G09G 2310/0286* (2013.01)

(58) Field of Classification Search
CPC ..... G09G 3/32; G09G 2300/0842; G09G 2310/0216; G09G 2310/0286; G09G 3/3266; G09G 2300/0819; G09G 2300/0861; G09G 2310/0251; G09G 2310/0262; G09G 2320/043; G09G 3/3233; G09G 3/3225
See application file for complete search history.

(56) References Cited

U.S. PATENT DOCUMENTS

2019/0180675 A1* 6/2019 Jang ..... G09G 3/3233
2020/0286432 A1* 9/2020 Zhang ..... G09G 3/3266
2021/0280130 A1* 9/2021 Wang ..... G09G 3/3233
2022/0173189 A1* 6/2022 Kim ..... H10K 59/1213
2022/0319438 A1* 10/2022 Sun ..... H10K 59/00

FOREIGN PATENT DOCUMENTS

CN 106558287 A 4/2017
CN 112735314 A 4/2021

* cited by examiner

*Primary Examiner* — Andrew Sasinowski
(74) *Attorney, Agent, or Firm* — KDW Firm PLLC

(57) ABSTRACT

Provided are a display panel and a driving method thereof, an array substrate, a display panel, and a display device. The pixel circuit includes a drive circuit, a first initialization circuit, a data write circuit, and a threshold compensation circuit. The control terminal of the drive circuit is electrically connected to a first node. A first terminal of the drive circuit is electrically connected to a second node, and a second terminal of the drive circuit is electrically connected to a third node. A first terminal of the first initialization circuit is electrically connected to a first reference signal terminal, and a second terminal of the first initialization circuit is electrically connected to the third node. The control terminal of the data write circuit is electrically connected to a scanning signal terminal.

26 Claims, 16 Drawing Sheets

DISPLAY PANEL AND DRIVING METHOD THEREOF, ARRAY SUBSTRATE, DISPLAY PANEL, AND DISPLAY DEVICE

CROSS-REFERENCE TO RELATED APPLICATION(S)

This application claims priority to Chinese Patent Application No. 202211153729.3 filed Sep. 21, 2022, the disclosure of which is incorporated herein by reference in its entirety.

TECHNICAL FIELD

Embodiments of the present disclosure relate to display technology and, in particular, to a display panel and a driving method thereof, an array substrate, a display panel, and a display device.

BACKGROUND

With the development of display technology, an organic light-emitting diode (OLED) display is increasingly widely used in the display field and gradually replaces a conventional liquid crystal display (LCD) due to its advantages such as self-light emitting, a wide viewing angle, high contrast, low power consumption, and a fast response speed.

To improve the display stability of an OLED, a pixel circuit that drives the OLED to emit light includes multiple transistors. Since a metal oxide (for example, indium gallium zinc oxide (IGZO)) transistor has the advantages of a high transmittance, low electron mobility, a great switch ratio, and low power consumption compared with a low-temperature polycrystalline silicon (LTPS) transistor. In the design of the existing pixel circuit, IGZO transistors are used to replace part of LTPS transistors to reduce the leakage current of the circuit. However, since there are two different types of transistors in the pixel circuit, LTPS p-type transistors and IGZO n-type transistors, three sets of different scanning circuits are required for driving in the pixel circuit, and a narrower bezel cannot be obtained.

SUMMARY

Embodiments of the present disclosure provide a display panel and a driving method thereof, an array substrate, a display panel, and a display device. The pixel circuit needs only two sets of scanning circuits to implement driving. A perimeter driver circuit is simplified, and a narrower bezel of the display panel is implemented.

In a first aspect, an embodiment of the present disclosure provides a pixel circuit. The pixel circuit includes a drive circuit, a first initialization circuit, a data write circuit, and a threshold compensation circuit.

The control terminal of the drive circuit is electrically connected to a first node. A first terminal of the drive circuit is electrically connected to a second node, and a second terminal of the drive circuit is electrically connected to a third node.

A first terminal of the first initialization circuit is electrically connected to a first reference signal terminal, and a second terminal of the first initialization circuit is electrically connected to the third node.

The control terminal of the data write circuit is electrically connected to a scanning signal terminal. A first terminal of the data write circuit is electrically connected to a data signal terminal, and a second terminal of the data write circuit is electrically connected to the second node.

The control terminal of the threshold compensation circuit is electrically connected to an enable signal terminal. A first terminal of the threshold compensation circuit is electrically connected to the third node, and a second terminal of the threshold compensation circuit is electrically connected to the first node.

In a second aspect, an embodiment of the present disclosure provides a driving method of a pixel circuit. The method is used for driving the preceding pixel circuit and includes the steps below.

In an initialization stage, the first initialization circuit and the threshold compensation circuit are controlled to turn on. The data write circuit and the drive circuit are controlled to turn off. The first initialization circuit initializes the potential of the first node.

In a data write stage, the data write circuit, the drive circuit, and the threshold compensation circuit are controlled to turn on. The first initialization circuit is controlled to turn off. The data write circuit writes a data signal to the first node.

In a light emission stage, the drive circuit is controlled to turn on. The data write circuit, the first initialization circuit, and the threshold compensation circuit are controlled to turn off. The drive circuit provides a drive current to a light-emitting element. The light-emitting element emits light in response to the drive current.

In a third aspect, an embodiment of the present disclosure provides an array substrate. The array substrate includes a display region. The display region includes multiple pixel circuits arranged in an array.

In a fourth aspect, an embodiment of the present disclosure provides a display panel. The display panel includes the preceding array substrate.

In a fifth aspect, an embodiment of the present disclosure provides a display device. The display device includes the preceding display panel.

The pixel circuit provided by the embodiments of the present disclosure includes a drive circuit, a first initialization circuit, a data write circuit, and a threshold compensation circuit. The control terminal of the drive circuit is electrically connected to the first node. The first terminal of the drive circuit is electrically connected to the second node, and the second terminal of the drive circuit is electrically connected to the third node. The first terminal of the first initialization circuit is electrically connected to the first reference signal terminal, and the second terminal of the first initialization circuit is electrically connected to the third node. The control terminal of the data write circuit is electrically connected to the scanning signal terminal. The first terminal of the data write circuit is electrically connected to the data signal terminal, and the second terminal of the data write circuit is electrically connected to the second node. The control terminal of the threshold compensation circuit is electrically connected to the enable signal terminal. The first terminal of the threshold compensation circuit is electrically connected to the third node, and the second terminal of the threshold compensation circuit is electrically connected to the first node. Compared with the related art, the pixel circuit provided by the embodiments of the present disclosure needs to be provided with only one scanning signal terminal and one enable signal terminal and needs to be provided with only two sets of scanning circuits to implement driving. In this manner, the perimeter driver circuit is simplified, and the narrower bezel of the display panel is implemented.

DETAILED DESCRIPTION

Figure 1:
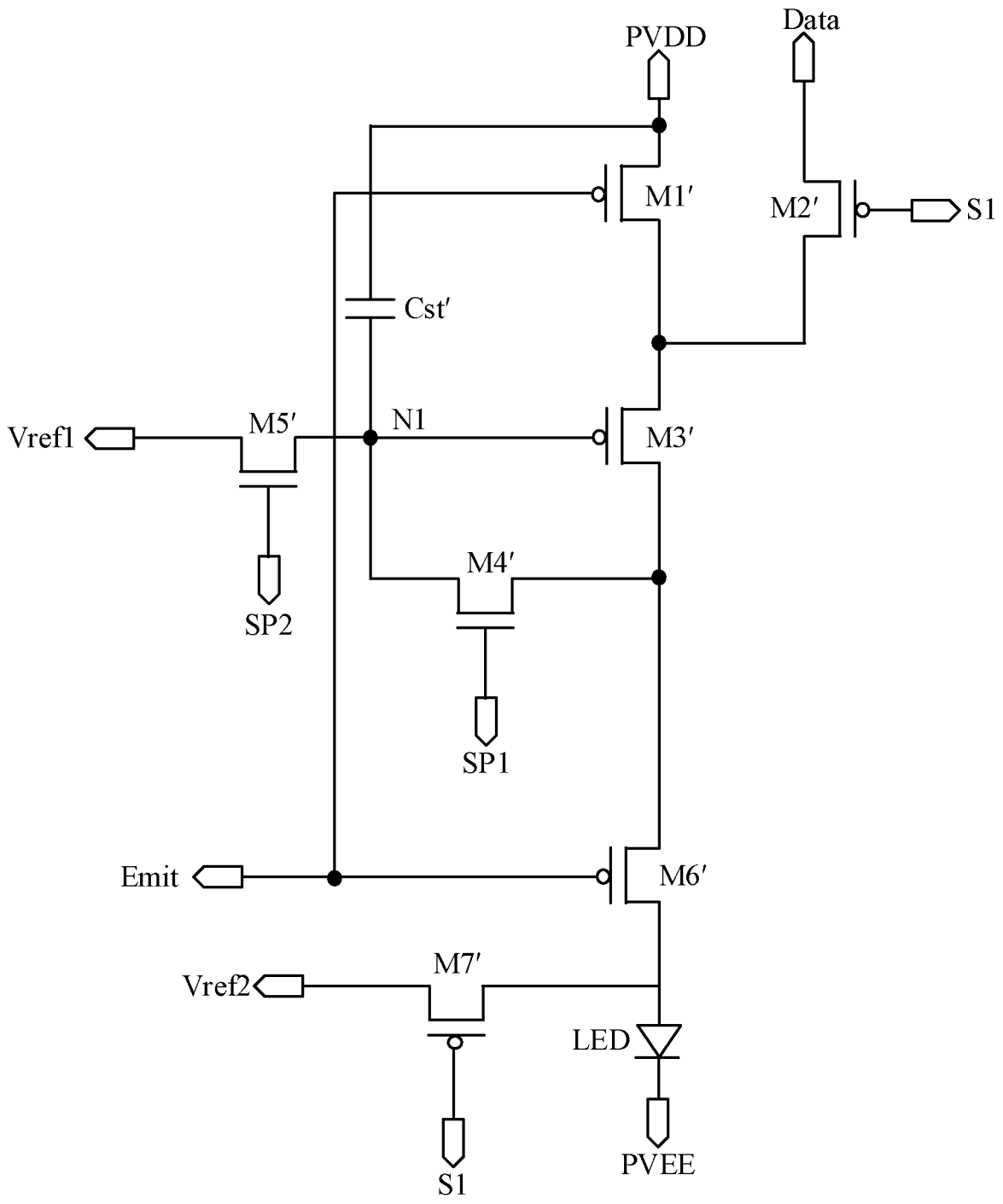
FIG. 1 is a diagram illustrating the structure of a pixel circuit in the related art.

Hereinafter the present disclosure is further described in detail in conjunction with the drawings and embodiments. It is to be understood that the specific embodiments set forth below are intended to illustrate and not to limit the present disclosure. Additionally, it is to be noted that, for ease of description, only part, not all, of structures related to the present disclosure are illustrated in the drawings.

Terms used in the embodiments of the present disclosure are merely used to describe the specific embodiments and not intended to limit the present disclosure. It is to be noted that nouns of locality, including "on", "below", "left" and "right", used in the embodiments of the present disclosure, are described from the angles illustrated in the drawings and are not to be construed as a limitation to the embodiments of the present disclosure. Additionally, in the context, it is to be understood that when an element is formed "on" or "below" another element, the element may be directly formed "on" or "below" another element, or may be indirectly formed "on" or "below" another element via an intermediate element. The terms "first", "second" and the like are merely used for description and used to distinguish between different components rather than indicate any order, quantity, or importance. For those of ordinary skill in the art, the preceding terms can be construed according to specific situations in the present disclosure.

FIG. 1 is a diagram illustrating the structure of a pixel circuit in the related art. Referring to FIG. 1, the pixel circuit includes seven transistors M1' to M7' and a capacitor Cst'. M1', M2', M3', M6', and M7' all use LTPS P-type transistors. To reduce the leakage current of a node N1, M4' and M5' use IGZO n-type transistors. In the pixel circuit shown in FIG. 1, the gate of M1' and the gate of M6' are connected to an enable signal terminal Emit. The gate of M2' and the gate of M7' are connected to a scanning signal terminal S1. The gate of M4' is connected to a scanning signal terminal SP1. The gate of M5' is connected to a scanning signal terminal SP2. Since there are two different types of transistors in the pixel circuit, when the circuit is controlled, the scanning signal requires three sets of scanning circuits of SP (SP1 and SP2), S (S1), and Emit to provide three different timing for driving respectively. Thus, the left and right bezels of a display panel become larger, resulting in the inability to obtain a narrower bezel.

Figure 2:
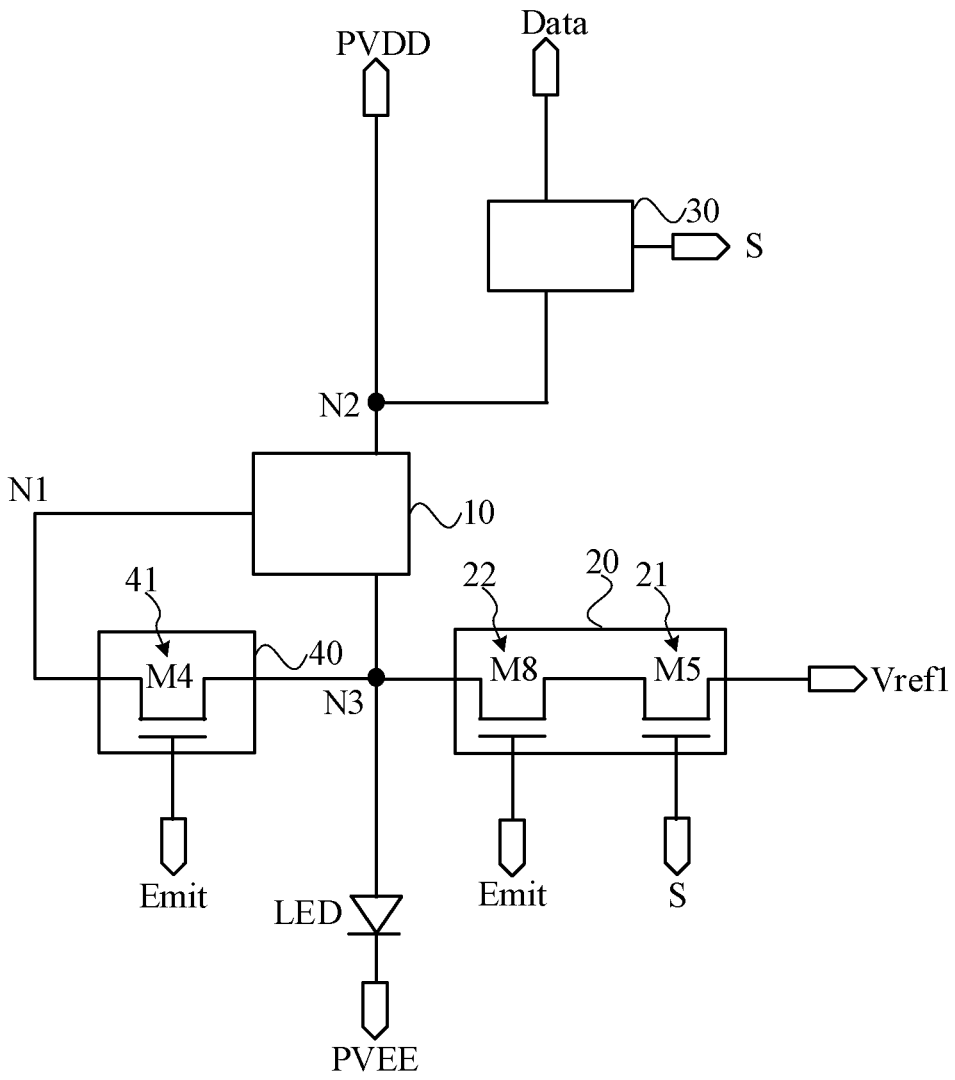
FIG. 2 is a diagram illustrating the structure of a pixel circuit according to an embodiment of the present disclosure.

To solve the preceding problems, FIG. 2 is a diagram illustrating the structure of a pixel circuit according to an embodiment of the present disclosure. Referring to FIG. 2, the pixel circuit includes a drive circuit 10, a first initialization circuit 20, a data write circuit 30, and a threshold compensation circuit 40. The control terminal of the drive circuit 10 is electrically connected to a first node N1. A first terminal of the drive circuit 10 is electrically connected to a first power voltage terminal PVDD, and a second terminal of the drive circuit 10 is electrically connected to a first electrode of a light-emitting element (for example, an LED). A first terminal of the first initialization circuit 20 is electrically connected to a first reference signal terminal Vref1, and a second terminal of the first initialization circuit 20 is electrically connected to a third node N3. The control terminal of the data write circuit 30 is electrically connected to a scanning signal terminal S. A first terminal of the data write circuit 30 is electrically connected to a data signal terminal Data, and a second terminal of the data write circuit 30 is electrically connected to the first terminal of the drive circuit 10. The control terminal of the threshold compensation circuit 40 is electrically connected to an enable signal terminal Emit. A first terminal of the threshold compensation circuit 40 is electrically connected to the third node N3, and a second terminal of the threshold compensation circuit 40 is electrically connected to the first node N1. The first initialization circuit 20 includes a first n-type transistor 21 (M5) and a second n-type transistor 22 (M8). The control terminal of the first n-type transistor 21 is electrically connected to the scanning signal terminal S. A first terminal of the first n-type transistor 21 is electrically connected to the first reference signal terminal Vref1, and a second terminal of the first n-type transistor 21 is electrically connected to a first terminal of the second n-type transistor 22. The control terminal of the second n-type transistor 22 is electrically connected to the enable signal terminal Emit. A second terminal of the second n-type transistor 22 is electrically connected to the third node N3. The threshold compensation circuit 40 includes a third n-type transistor 41 (M4). The control terminal of the third n-type transistor 41 is electrically connected to the enable signal terminal Emit. A first terminal of the third n-type transistor 41 is electrically connected to the third node N3, and a second terminal of the third n-type transistor 41 is electrically connected to the first node N1.

The drive circuit 10 is configured to drive the light-emitting element LED to emit light according to a data signal. The drive circuit 10 may include a drive transistor formed of an n-type transistor or a p-type transistor. During specific implementation, the electrical connection between the first terminal of the drive circuit 10 and the first power voltage terminal PVDD may be a direct electrical connection, or an indirect electrical connection through another component disposed in the middle, or a coupled connection. The data write circuit 30 is configured to write a data signal to the first node N1 under the control of the corresponding scanning signal terminal S. The data signal is used to control the magnitude of the drive current output by the drive circuit 10 to control the brightness of the light-emitting element. The data write circuit 30 may include a p-type transistor. The first initialization circuit 20 is configured to initialize the voltage of the first node N1. The control signal output by the scanning signal terminal S and the control signal output by the enable signal terminal Emit control the first n-type transistor 21 and the second n-type transistor 22 to turn on and off separately. The control terminal of the first n-type transistor 21 and the control terminal of the data write circuit 30 are connected to the same scanning signal terminal S. In this manner, compared with the related art, the effect of reducing a set of scanning circuits is implemented. The threshold compensation circuit 40 is configured to implement the threshold compensation of the gate of the drive transistor in the drive circuit 10. During specific implementation, when the data write circuit 30 writes the data signal to the first node N1, the third n-type transistor 41 is controlled to turn on through the control signal of the enable signal terminal Emit. The data voltage VData provided by the data signal terminal Data is written to the first node N1 through the drive circuit 10 and the third n-type transistor 41. The voltage of the second node N2 is VData. The voltage of the first node N1 is VData−Vth. Vth is the threshold voltage of the drive transistor in the drive circuit. A voltage related to Vth is pre-stored at the first node N1, and then the amount related to Vth in the current formula of the light-emitting element may be eliminated. Thus, the current flowing through the light-emitting element has nothing to do with Vth, and threshold compensation is implemented.

The pixel circuit provided by this embodiment of the present disclosure needs to be provided with only one scanning signal terminal and one enable signal terminal and needs to be provided with only two sets of scanning circuits to implement driving. In this manner, a perimeter driver circuit is simplified, and a narrower bezel of a display panel is implemented.

Optionally, in an embodiment, each of the first n-type transistor 21, the second n-type transistor 22, and the third n-type transistor 41 is a transistor including an oxide semiconductor, for example, an IGZO transistor. In other embodiments, the first n-type transistor 21, the second n-type transistor 22, and the third n-type transistor 41 may also be other types of oxide semiconductor transistors and may be selected according to actual situations during the specific implementation.

Figure 3:
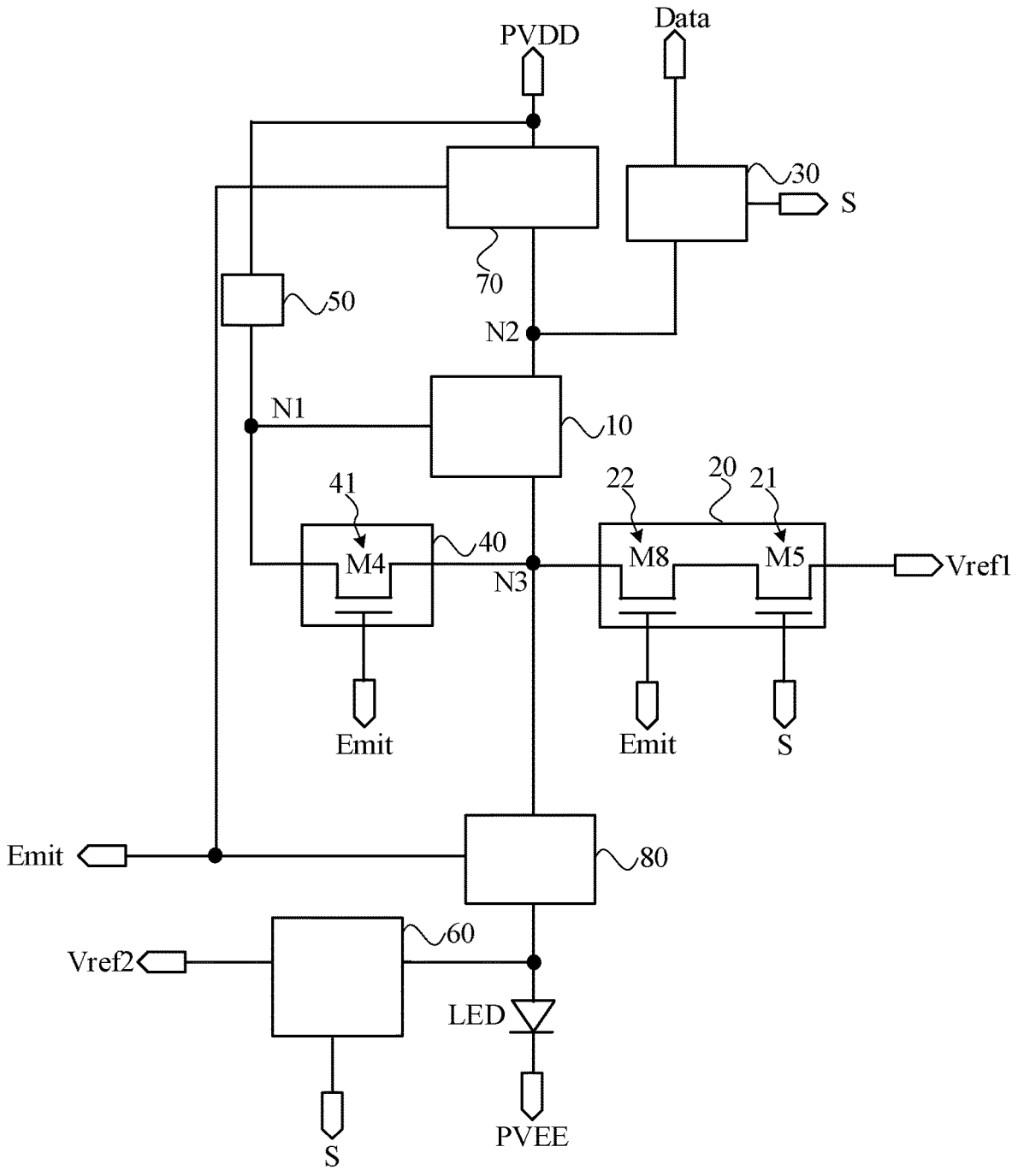
FIG. 3 is a diagram illustrating the structure of another pixel circuit according to an embodiment of the present disclosure.

FIG. 3 is a diagram illustrating the structure of another pixel circuit according to an embodiment of the present disclosure. Referring to FIG. 3, optionally, the pixel circuit also includes a storage circuit 50, a second initialization circuit 60, a first light emission control circuit 70, and/or a second light emission control circuit 80. A first terminal of the storage circuit 50 is electrically connected to the first power voltage terminal PVDD, and a second terminal of the storage circuit 50 is electrically connected to the first node N1. The control terminal of the second initialization circuit 60 is electrically connected to the scanning signal terminal S. A first terminal of the second initialization circuit 60 is electrically connected to a second reference signal terminal Vref2, and a second terminal of the second initialization circuit 60 is electrically connected to the first electrode of the light-emitting element LED. The control terminal of the first light emission control circuit 70 is electrically connected to the enable signal terminal Emit. A first terminal of the first light emission control circuit 70 is electrically connected to the first power voltage terminal PVDD, and a second terminal of the first light emission control circuit 70 is electrically connected to the first terminal of the drive circuit 10. The control terminal of the second light emission control circuit 80 is electrically connected to the enable signal terminal Emit. A first terminal of the second light emission control circuit 80 is electrically connected to the second terminal (third node N3) of the drive circuit 10, and a second terminal of the second light emission control circuit 80 is electrically connected to the first electrode of the light-emitting element LED. A second electrode of the light-emitting element is electrically connected to a second power voltage terminal PVEE.

The storage circuit 50 is configured to maintain the potential of the first node N1 when the light-emitting element LED is in a light emission stage. The second initialization circuit 60 is configured to reset the first electrode (for example, the anode) of the light-emitting element LED before the light-emitting element LED emits light to prevent the brightness from being affected by the last light emission. The first light emission control circuit 70 and/or the second light emission control circuit 80 is configured to be on in the light emission stage, so that the light-emitting element LED emits light after the drive current flows through the light-emitting element LED. In an embodiment, the first electrode of the light-emitting element LED is an anode, and the second electrode of the light-emitting element LED is a cathode. The first power voltage terminal PVDD supplies an anode voltage, and the second power voltage terminal PVEE supplies a cathode voltage.

Figure 4:
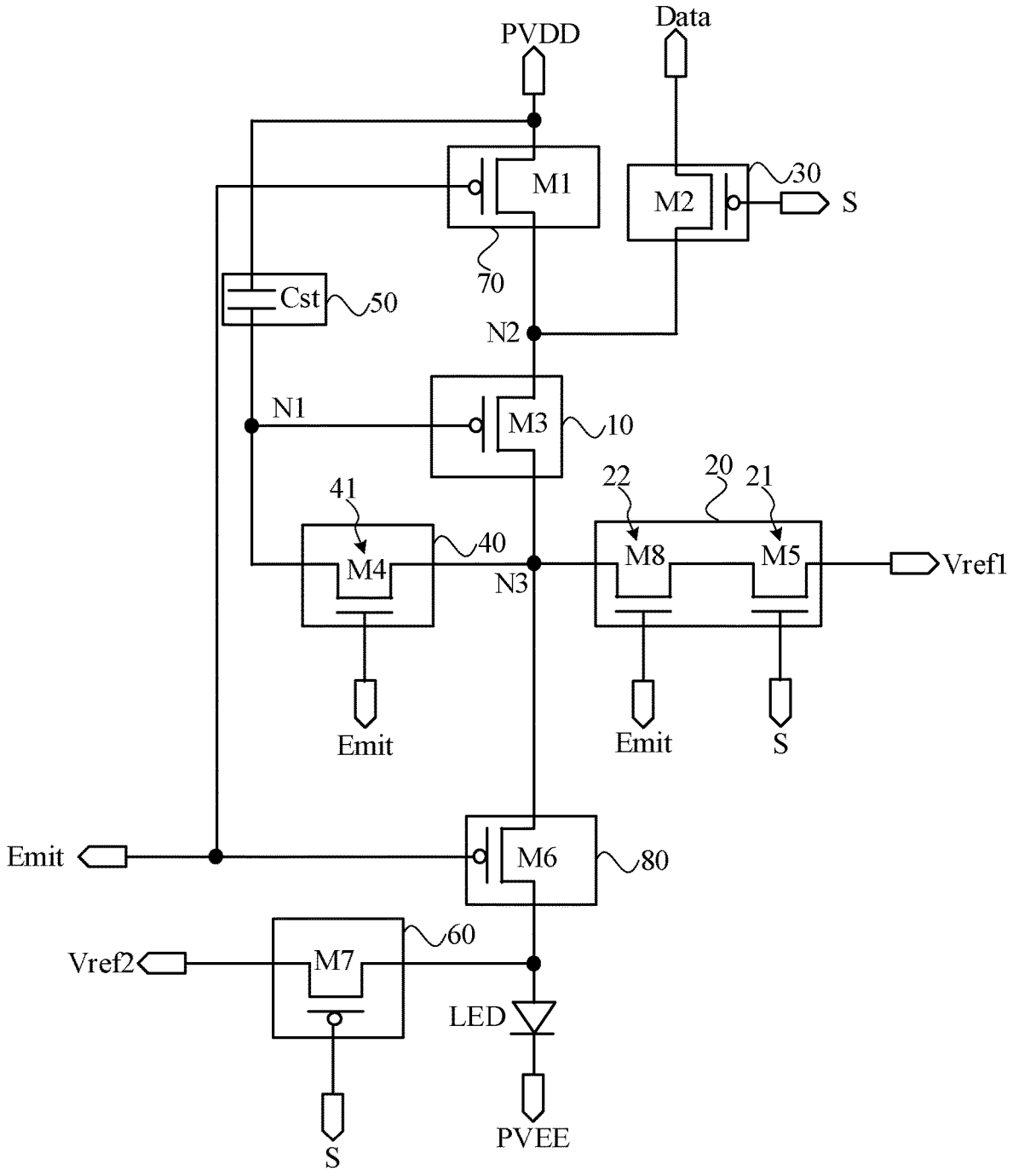
FIG. 4 is a diagram illustrating the specific circuit structure of a pixel circuit according to an embodiment of the present disclosure.

FIG. 4 is a diagram illustrating the specific circuit structure of a pixel circuit according to an embodiment of the present disclosure. Referring to FIG. 4, optionally, the drive circuit 10 includes a drive transistor M3. The data write circuit 30 includes a fourth transistor M2. The first light emission control circuit 70 includes a fifth transistor M1. The second light emission control circuit 80 includes a sixth transistor M6. The second initialization circuit 60 includes a seventh transistor M7. The storage circuit 50 includes a first capacitor Cst. The control terminal of the fifth transistor M1 is electrically connected to the enable signal terminal Emit. A first terminal of the fifth transistor M1 is electrically connected to the first power voltage terminal PVDD, and a second terminal of the fifth transistor M1 is electrically connected to a first terminal (the second node N2) of the drive transistor M3. The control terminal of the drive transistor M3 is electrically connected to the first node N1. A second terminal (the third node N3) of the drive transistor M3 is electrically connected to a first terminal of the sixth transistor M6. The control terminal of the fourth transistor M2 is electrically connected to the scanning signal terminal S. A first terminal of the fourth transistor M2 is electrically connected to the data signal terminal Data, and a second terminal of the fourth transistor M2 is connected to the first terminal of the drive transistor M3. The control terminal of the sixth transistor M6 is electrically connected to the enable signal terminal Emit. A second terminal of the sixth transistor M6 is electrically connected to the first electrode of the light-emitting element LED. The control terminal of the seventh transistor M7 is electrically connected to the scanning signal terminal S. A first terminal of the seventh transistor M7 is electrically connected to the second reference signal terminal Vref2, and a second terminal of the seventh transistor M7 is electrically connected to the first electrode of the light-emitting element LED. A first terminal of the first capacitor Cst is electrically connected to the first node N1, and a second terminal of the first capacitor Cst is electrically connected to the first power voltage terminal PVDD.

It is to be understood that since the first initialization circuit 20 and the second initialization circuit 60 may work in different time periods, two initialization signals may also be provided by the same signal line at different times. For example, in this embodiment, the first reference signal terminal Vref1 and the second reference signal terminal Vref2 are the same signal terminal. In this manner, the number of wires can be reduced, and the structure of the pixel circuit can be simplified.

Optionally, in an embodiment, the drive transistor M3, the fourth transistor M2, the fifth transistor M1, the sixth transistor M6, and the seventh transistor M7 are each a p-type transistor. Further, the p-type transistor is a transistor including a low-temperature polycrystalline silicon (LTPS) semiconductor. A transistor formed by an LTPS technique has the advantages of high mobility and fast charging.

Figure 5:
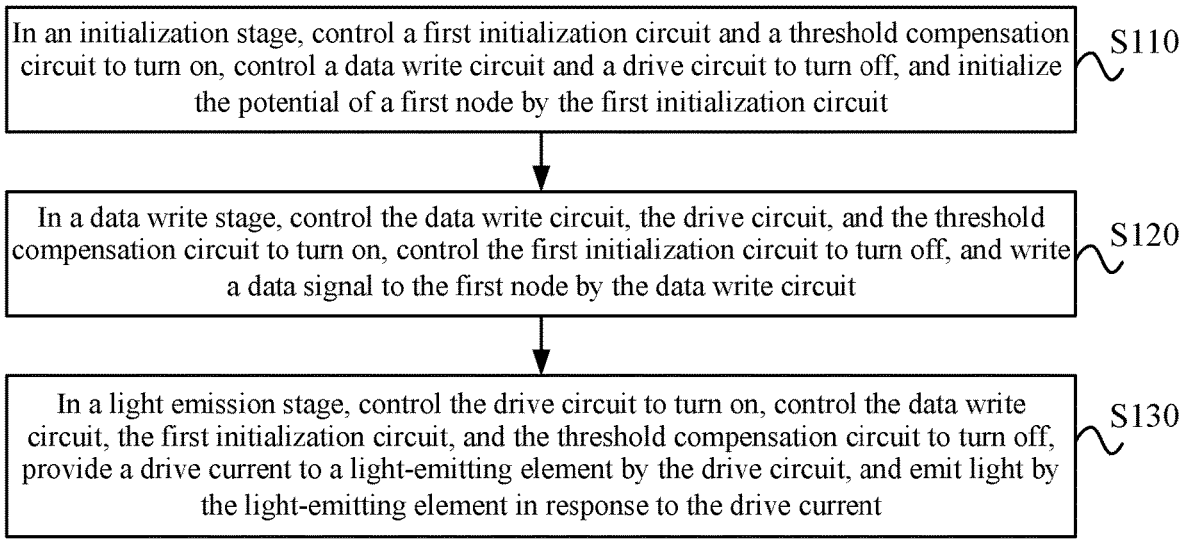
FIG. 5 is a flowchart of a driving method of a pixel circuit according to an embodiment of the present disclosure.

In the preceding embodiment, the specific structure of the pixel circuit provided by this embodiment of the present disclosure is introduced. Since the pixel circuit provided by this embodiment of the present disclosure reduces the number of scanning circuits compared with the existing pixel circuit, and the driving method thereof is also different from the related art, the working principle of the pixel circuit is described below in combination with the driving method of the pixel circuit. FIG. 5 is a flowchart of a driving method of a pixel circuit according to an embodiment of the present disclosure. The driving method is used to drive the pixel circuit provided by the preceding embodiment. Referring to FIG. 5, the driving method includes the steps below.

In step 110, in an initialization stage, the first initialization circuit and the threshold compensation circuit are controlled to turn on. The data write circuit and the drive circuit are controlled to turn off. The first initialization circuit initializes the potential of the first node.

The initialization stage is the first stage controlled by the pixel circuit and is used for initializing the potential of the first node. When the reference voltage provided from the first reference signal terminal is written to the first node through the first initialization circuit. For example, when the drive transistor in the drive circuit is a P-type transistor, the reference voltage is a logic low level signal. Specifically, the voltage of the logic low level signal may be selected according to actual situations.

In step 120, in a data write stage, the data write circuit, the drive circuit, and the threshold compensation circuit are controlled to turn on. The first initialization circuit is controlled to turn off. The data write circuit writes the data signal to the first node.

The data write stage is the second stage controlled by the pixel circuit and is used for writing the data signal to the first node. At the same time, the threshold compensation of the drive transistor in the drive circuit is implemented. The voltage value of the data signal is different, and the turn-on degree of the drive circuit in the drive circuit is different in the subsequent light emission stage. Thus, the magnitude of the drive current is controlled, thereby controlling the light-emitting element to implement display of different brightness.

In step 130, in the light emission stage, the drive circuit is controlled to turn on. The data write circuit, the first initialization circuit, and the threshold compensation circuit are controlled to turn off. The drive circuit provides the drive current to the light-emitting element. The light-emitting element emits light in response to the drive current.

The light emission stage is the third stage controlled by the pixel circuit. The display of different brightness of the light-emitting element may be implemented according to different data voltages input in the previous stage. For the entire display panel, all pixel circuits are scanned row by row to implement image display.

Figure 6:
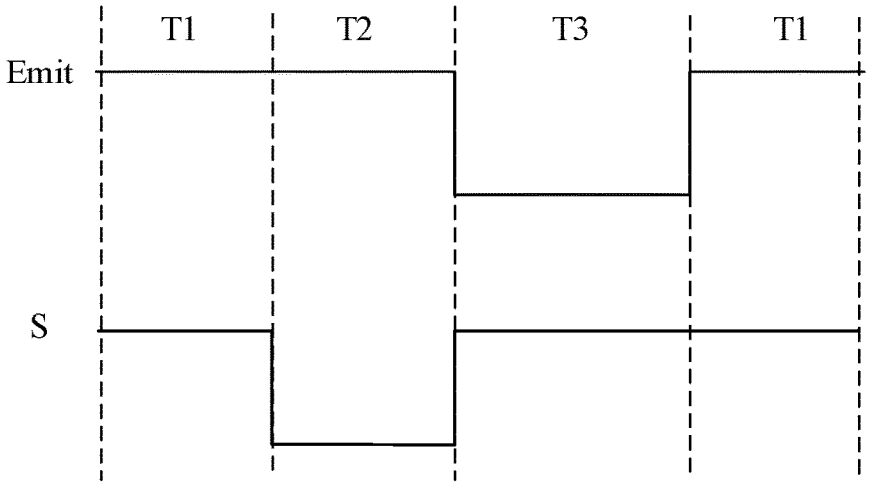
FIG. 6 is a drive timing graph of the control signal of a pixel circuit according to an embodiment of the present disclosure.
Figure 7:
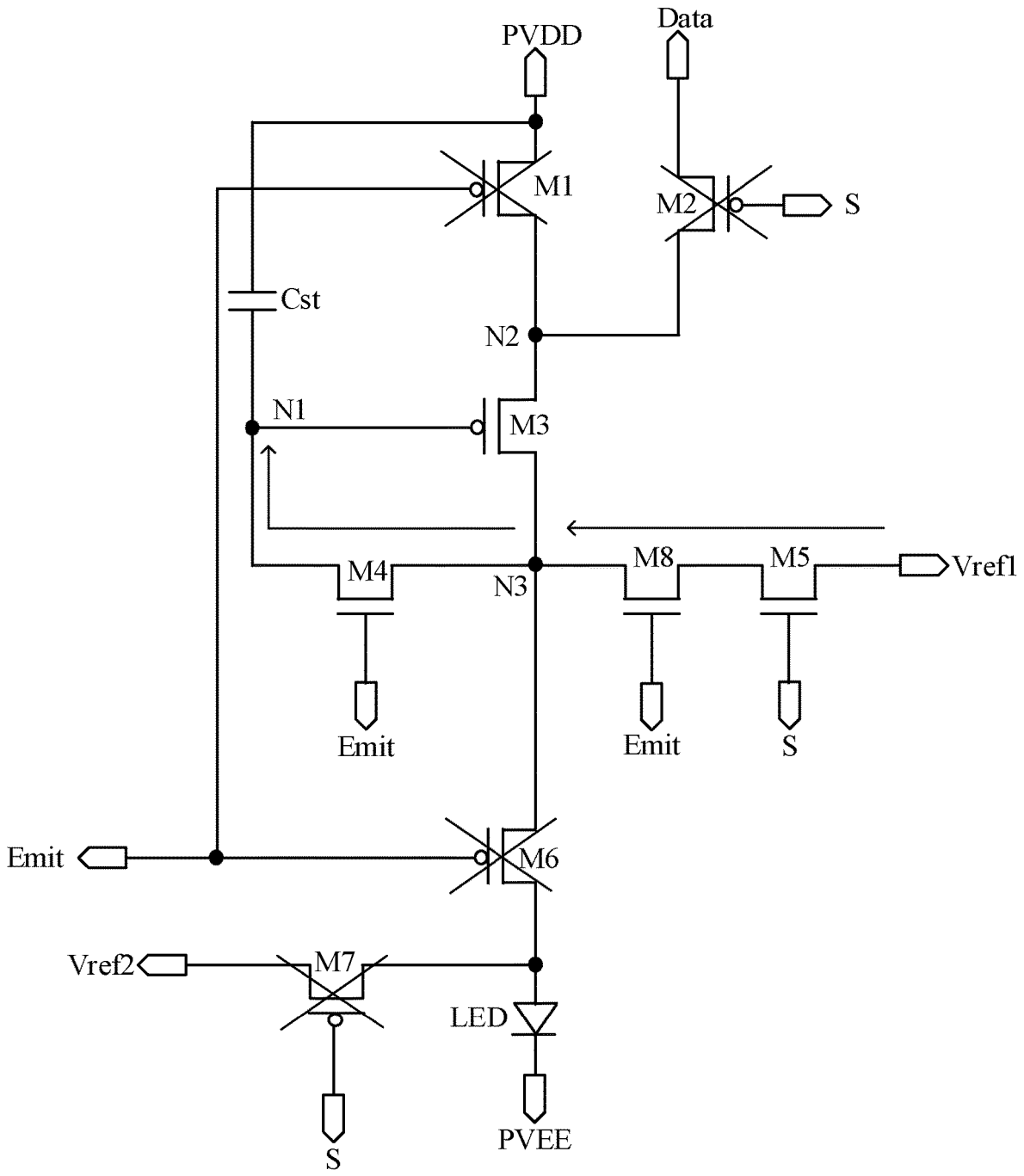
FIG. 7 is a diagram illustrating the structure of a pixel circuit in an initialization stage according to an embodiment of the present disclosure.
Figure 8:
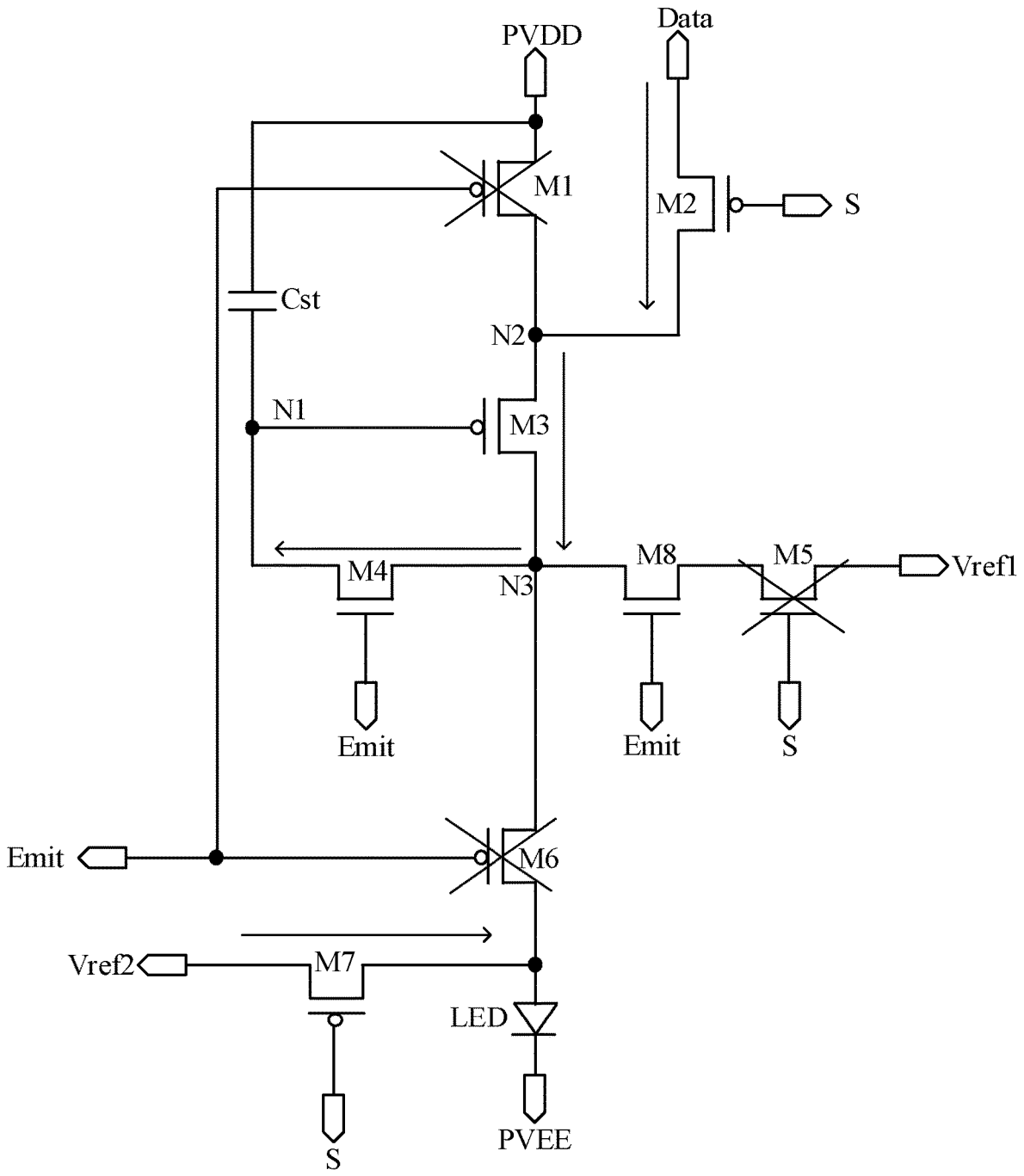
FIG. 8 is a diagram illustrating the structure of a pixel circuit in a data write stage according to an embodiment of the present disclosure.
Figure 9:
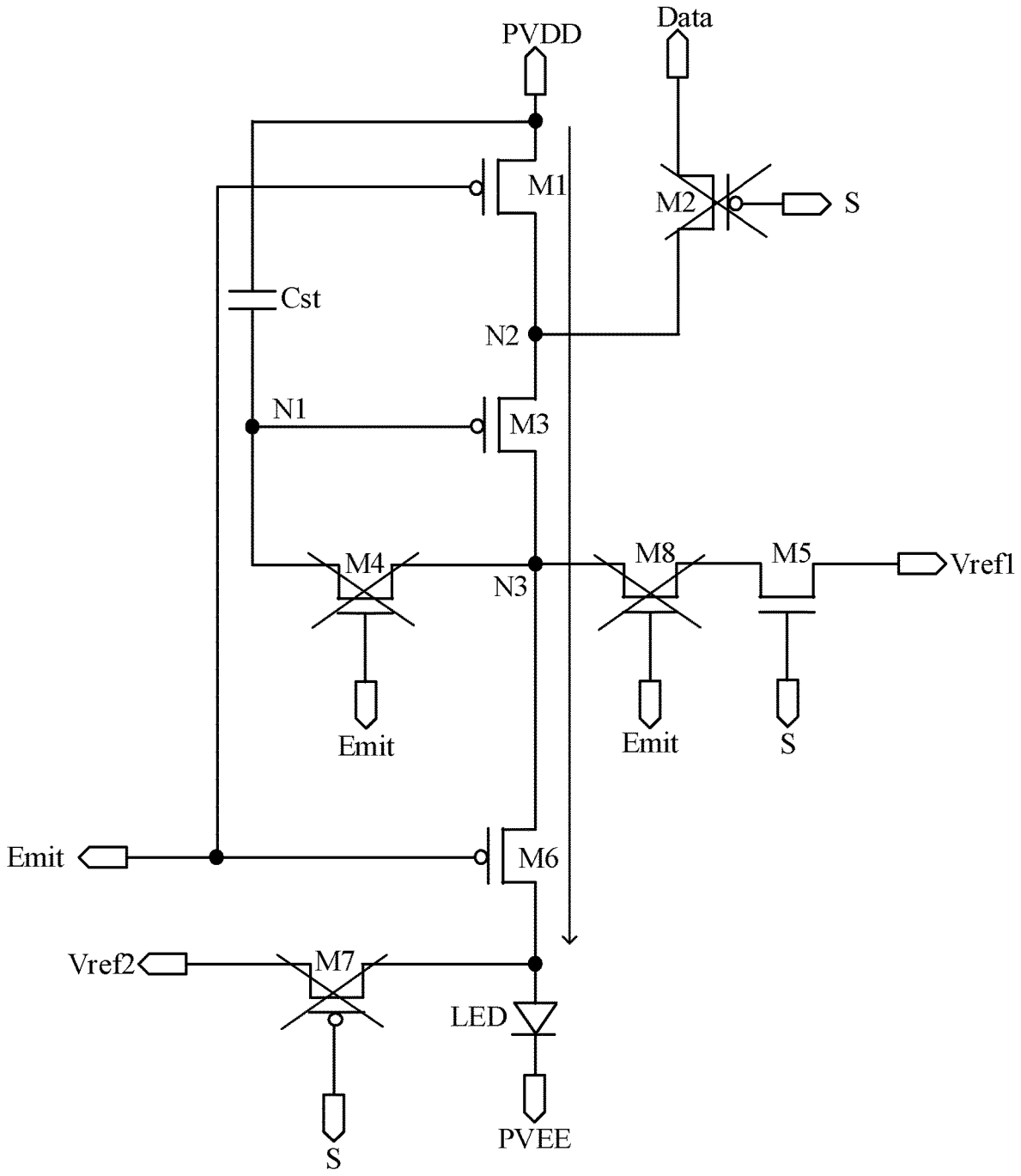
FIG. 9 is a diagram illustrating the structure of a pixel circuit in a light emission stage according to an embodiment of the present disclosure.

Optionally, the first initialization circuit includes a first n-type transistor and a second n-type transistor. The control terminal of the first n-type transistor is electrically connected to the scanning signal terminal S. The control terminal of the second n-type transistor is electrically connected to the enable signal terminal Emit. The pixel circuit also includes the threshold compensation circuit. The threshold compensation circuit includes a third n-type transistor. The drive circuit includes a drive transistor M3. The data write circuit includes a fourth transistor M2. The first light emission control circuit includes a fifth transistor M1. The second light emission control circuit includes a sixth transistor M6. The second initialization circuit includes a seventh transistor M7. The storage circuit includes a first capacitor Cst. FIG. 6 is a drive timing graph of the control signal of a pixel circuit according to an embodiment of the present disclosure. FIG. 7 is a diagram illustrating the structure of a pixel circuit in an initialization stage according to an embodiment of the present disclosure. FIG. 8 is a diagram illustrating the structure of a pixel circuit in a data write stage according to an embodiment of the present disclosure. FIG. 9 is a diagram illustrating the structure of a pixel circuit in a light emission stage according to an embodiment of the present disclosure. The driving method includes the steps below.

Referring to FIGS. 6 and 7, in the initialization stage T1, the first n-type transistor M5 is controlled to turn on through the control signal output by the scanning signal terminal S, the second n-type transistor M8 is controlled to turn on through the control signal output by the enable signal terminal Emit, so that the first initialization circuit is turned on.

It is to be understood that an n-type transistor is turned on when a gate voltage is at a logic high level, and a p-type transistor is turned on when a gate voltage is at a logic low level. In the initialization stage T1, the scanning signal terminal S outputs a logic high level, and the logic high level controls the first n-type transistor M5 to turn on. The enable signal terminal Emit outputs a logic high level, and the logic high level controls the second n-type transistor M8 and the third n-type transistor M4 to turn on. The reference voltage (a logic low level voltage) provided by the first reference signal terminal Vref1 is input to the first node N1 through the first n-type transistor M5, the second n-type transistor M8, and the third n-type transistor M4 to implement the initialization of the first node N1. In this stage, the fifth transistor M1 and the sixth transistor M6 are turned off under the control of the logic high level provided by the enable signal terminal Emit, and the fourth transistor M2 and the seventh transistor M7 are turned off under the control of the logic high level provided by the scanning signal terminal S.

Referring to FIGS. 6 and 8, in the data write stage T2, the first n-type transistor M5 is controlled to turn off through the control signal output by the scanning signal terminal S, and the second n-type transistor M8 is controlled to turn on through the control signal output by the enable signal terminal Emit, so that the first initialization circuit is turned off.

In the data write stage T2, the scanning signal terminal S outputs a logic low level, and the enable signal terminal Emit outputs a logic high level. The fourth transistor M2 is turned on under the control of the logic low level provided by the scanning signal terminal S. The third n-type transistor M4 is turned on under the control of the logic high level provided by the enable signal terminal Emit. Since a logic low level is written to the first node N1 in the initialization stage T1, at this time, the drive transistor M3 is also in an on state. The data voltage provided by the data signal terminal Data is written to the first node N1 after passing through the fourth transistor M2, the drive transistor M3, and the third n-type transistor M4. At the same time, the threshold compensation of the gate of the drive transistor M3 is implemented. In this stage, the fifth transistor M1 and the sixth transistor M6 are turned off under the control of the logic high level provided by the enable signal terminal Emit. Although the second n-type transistor M8 is in an on state, the first n-type transistor M5 is turned off under the control of the logic low level provided by the scanning signal terminal S. Thus, the first initialization circuit is in an off state. In the data write stage T2, the seventh transistor M7 is turned on under the control of the logic low level provided by the scanning signal terminal S. The reference voltage provided by the second reference signal terminal Vref2 resets the first electrode of the light-emitting element LED.

Referring to FIGS. 6 and 9, in the light emission stage T3, the first n-type transistor M5 is controlled to turn on through the control signal output by the scanning signal terminal S, and the second n-type transistor M8 is controlled to turn off through the control signal output by the enable signal terminal Emit, so that the first initialization circuit is turned off.

In the light emission stage T3, the scanning signal terminal S outputs a logic high level, and the enable signal terminal Emit outputs a logic low level. The fifth transistor M1 and the sixth transistor M6 are turned on under the control of the logic low level provided by the enable signal terminal Emit. The third n-type transistor M4 is turned off under the control of the logic low level provided by the enable signal terminal Emit. The current provided by the first power voltage terminal PVDD flows into the light-emitting element LED after sequentially passing through the fifth transistor M1, the drive transistor M3, and the sixth transistor M6 to implement the display of the light-emitting element. In this stage, although the first n-type transistor M5 is turned on, the second n-type transistor M8 is turned off. Thus, the first initialization circuit is turned off. The seventh transistor M7 is turned off under the control of the logic high level provided by the scanning signal terminal S.

In conclusion, in the technical solutions provided by this embodiment of the present disclosure, only one scanning signal terminal and one enable signal terminal need to be configured to drive the corresponding pixel circuit. In this manner, the narrower bezel of the display panel is implemented.

An embodiment of the present disclosure provides an array substrate. The array substrate includes a display region. The display region includes multiple pixel circuits arranged in an array according to the preceding embodiments. Since the array substrate provided by this embodiment of the present disclosure includes any pixel circuit provided by the preceding embodiments, the array substrate has a technical effect of a narrow bezel.

Figure 10:
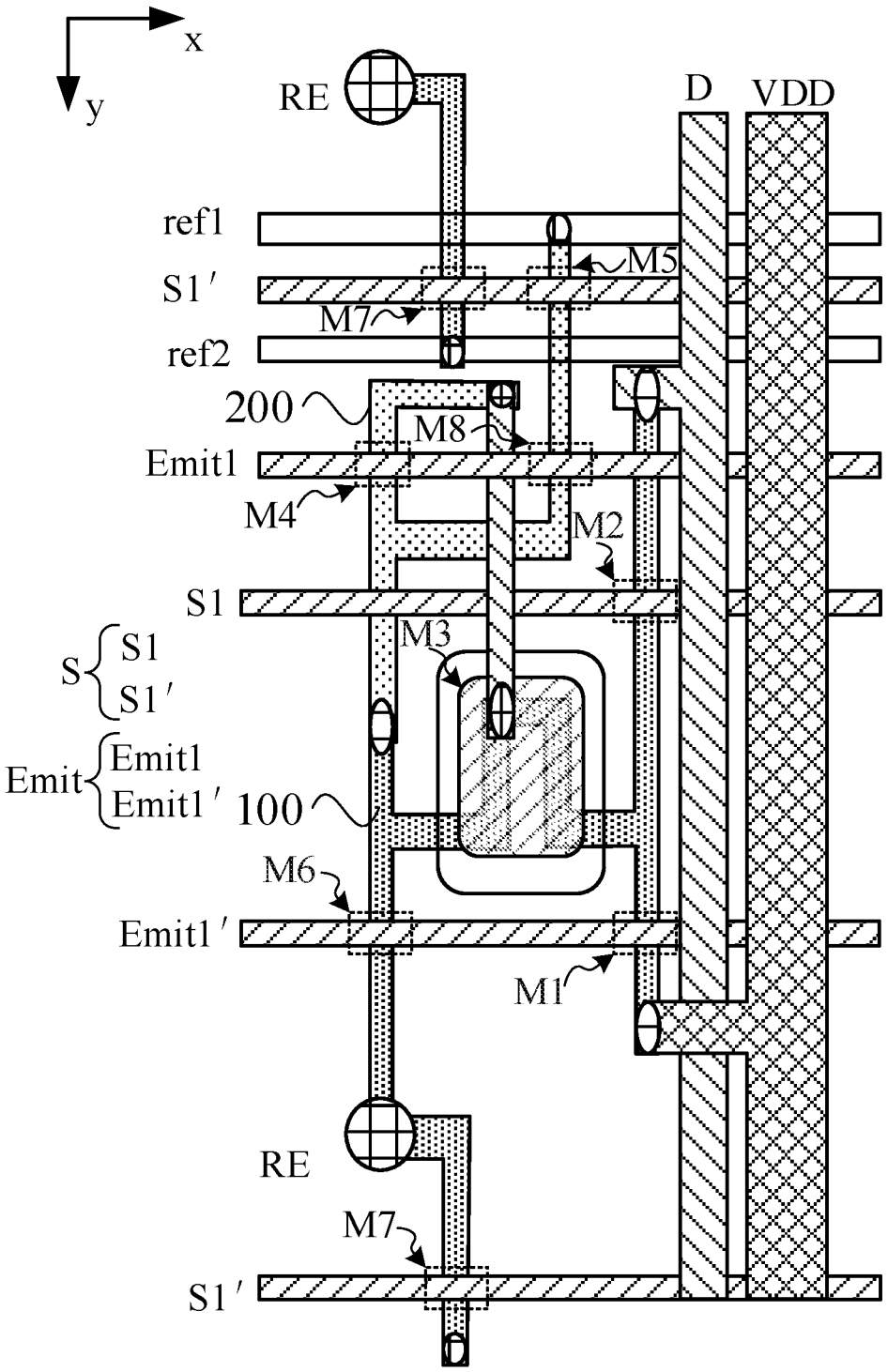
FIG. 10 is a diagram illustrating the structure of a pixel circuit on an array substrate according to an embodiment of the present disclosure.

FIG. 10 is a diagram illustrating the structure of a pixel circuit on an array substrate according to an embodiment of the present disclosure. Referring to FIG. 10, optionally, the pixel circuit includes a scanning signal line S and an enable signal line Emit extending in a first direction x. The scanning signal line S is electrically connected to the scanning signal terminal (not shown in FIG. 10) and configured to transmit the control signal of the scanning signal terminal to the pixel circuit. The enable signal line Emit is electrically connected to the enable signal terminal (not shown in FIG. 10) and configured to transmit the enable signal of the enable signal terminal to the pixel circuit.

Further referring to FIG. 10, optionally, the scanning signal line S includes a first scan line signal line S1 and a second scanning signal line S1'. The enable signal line Emit includes a first enable signal line Emit1 and a second enable signal line Emit1'. The first enable signal line Emit1 and the second enable signal line Emit1' are located on two sides of the drive circuit 10 separately. The first scanning signal line S1 is located between the first enable signal line Emit1 and the drive circuit 10. The second scanning signal line S1' is located on the side of the first enable signal line Emit1 facing away from the drive circuit 10.

The first scanning signal line S1 and the second scanning signal line S1' may be connected to the same scanning signal terminal (not shown in FIG. 10). The first enable signal line Emit1 and the second enable signal line Emit1' may be connected to the same enable signal terminal (not shown in FIG. 10). In this manner, the drive can be implemented by the use of two sets of scanning circuits. Compared to the related art in which three sets of scanning circuits need to be disposed, a narrow bezel is implemented.

Further referring to FIG. 10, optionally, the pixel circuit also includes a first semiconductor active layer 100 and a second semiconductor active layer 200. The second scanning signal line S1' overlaps the second semiconductor active layer 200 to form the first n-type transistor M5. The second scanning signal line S1' overlaps the first semiconductor active layer 100 to form the seventh transistor M7. A terminal of the seventh transistor M7 is connected to the anode RE of the light-emitting element. The first enable signal line Emit overlaps the second semiconductor active layer 200 to form the second n-type transistor M8 and the third n-type transistor M4. The first scanning signal line S1 overlaps the first semiconductor active layer 100 to form the fourth transistor M2. The second enable signal line Emit1' overlaps the first semiconductor active layer 100 to form the fifth transistor M1 and the sixth transistor M6.

It is to be understood that the region where the scanning signal line or the enable signal line overlaps a corresponding semiconductor active layer forms the gate of a transistor, and that two sides of the gate are doped with other elements to form the source and drain of the transistor. For the connection between transistors formed by the same type of active layer, an active layer is heavily doped so that a conductive function is implemented. The connection between transistors formed by different types of active layers may be implemented by a cross-layer metal wire. A design may be performed according to an actual circuit structure layout during the specific implementation.

The first semiconductor active layer 100 includes a low-temperature polycrystalline silicon active layer. The second semiconductor active layer 200 includes an oxide semiconductor active layer, for example, an IGZO active layer.

Further referring to FIG. 10, optionally, the pixel circuit also includes a data signal line D and a first power voltage signal line VDD extending in a second direction y. The data signal line D is electrically connected to the first terminal of the fourth transistor M2. The first power voltage signal line VDD is electrically connected to the first terminal of the fifth transistor M1. The second direction y intersects the first direction x.

A signal line and an active layer are located on different layers. A through hole may be formed at a corresponding position when a connection is required. For example, the circular (elliptical) region in FIG. 10 indicates the position of a through hole. The first direction x may be parallel to the row direction of the array formed by the pixel circuits. The second direction y may be parallel to the column direction of the array formed by the pixel circuits. The first scanning signal line S1, the second scanning signal line S1', the first enable signal line Emit1, and the second enable signal line Emit1' in the first direction x may be located on the same layer. The data signal line D and the first power voltage signal line VDD in the second direction y may be located on the same layer. In other embodiments, the first scanning signal line S1 and the second scanning signal line S1' may be configured to be located on the same layer, and the first enable signal line Emit1 and the second enable signal line Emit1' may be configured to be located on the same layer. However, the two types of signal lines are located on different layers. The data signal line D and the first power voltage signal line VDD are located on different layers. A design may be performed according to actual situations during the specific implementation. As shown in FIG. 10, the data signal line D and the first power voltage signal line VDD are located on different layers. If the two are located on the same layer, over-line processing may be performed on the overlapping position (the connection between the first power voltage signal line VDD and the fifth transistor M1) of the data signal line D and the first power voltage signal line VDD to avoid the short circuit of the two types of signal lines.

Optionally, the first semiconductor active layer is electrically connected to the second semiconductor active layer through a metal wire. The metal wire is on the same layer as the data signal line or the first power voltage signal line.

Since the material of the first semiconductor layer and the material of the second semiconductor layer are different, and the first semiconductor layer and the second semiconductor layer are generally disposed on different layers, the first semiconductor layer cannot be directly electrically connected to the second semiconductor layer. Thus, a connection wire needs to be disposed. FIG. 10 schematically shows that the first semiconductor active layer 100 and the second semiconductor active layer 200 are connected through the metal wire 300 on the same layer as the data signal line to implement the connection between the drive transistor M3 and the third n-type transistor M4. In other embodiments, the metal wire may also be on the same layer as the first power voltage signal line or on the same layer as other signal lines in the pixel circuit, but it must be ensured that the metal wire is insulated from the first scanning signal line S1.

In this embodiment, the type of the first n-type transistor M5 and the type of the seventh transistor M7 are different. To avoid the direct connection between the active layers of the two, a first reference signal line ref1 and a second reference signal line ref2 are provided. The first reference signal line ref1 and the second reference signal line ref2 are connected to the first reference signal terminal Vref1 and the second reference signal terminal Vref2 (not shown in FIG. 10) separately.

Figure 11:
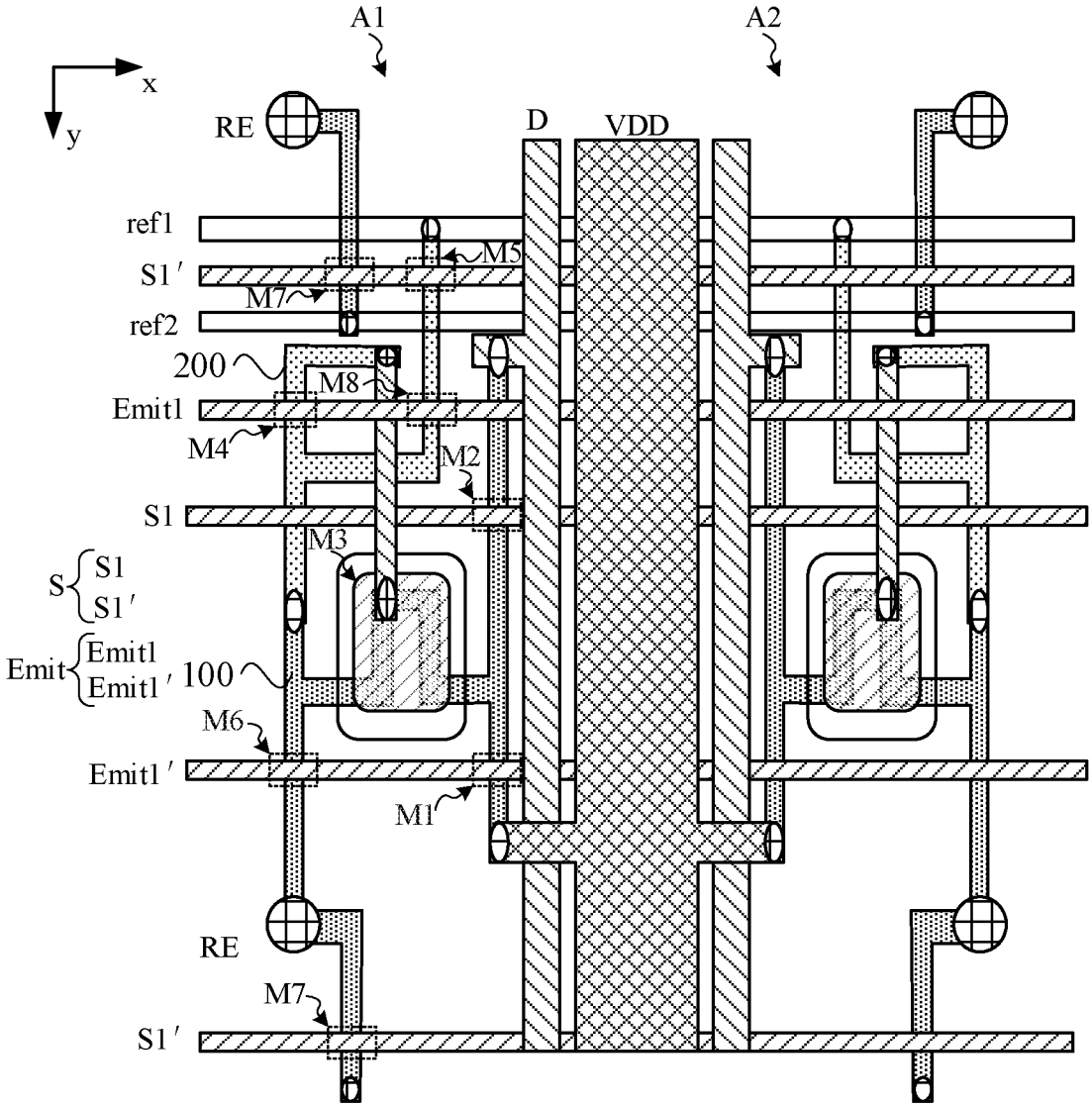
FIG. 11 is a diagram illustrating the structure of another pixel circuit on an array substrate according to an embodiment of the present disclosure.

FIG. 11 is a diagram illustrating the structure of another pixel circuit on an array substrate according to an embodiment of the present disclosure. Referring to FIG. 11, optionally, the pixel circuit includes a first pixel circuit A1 and a second pixel circuit A2. The first pixel circuit A1 and the second pixel circuit A2 share the same power voltage signal line VDD. The first pixel circuit A1 and the second pixel circuit A2 are symmetrically disposed about the power voltage signal line VDD.

The first pixel circuit A1 and the second pixel circuit A2 are configured to be symmetrically disposed about the power voltage signal line VDD, so that it is advantageous to reduce the number of power voltage signal lines VDD and simplify the circuit structure. Moreover, the width of the power voltage signal line VDD may be configured to be wider, so that a resistance is reduced, and a voltage drop is reduced.

Figure 12:
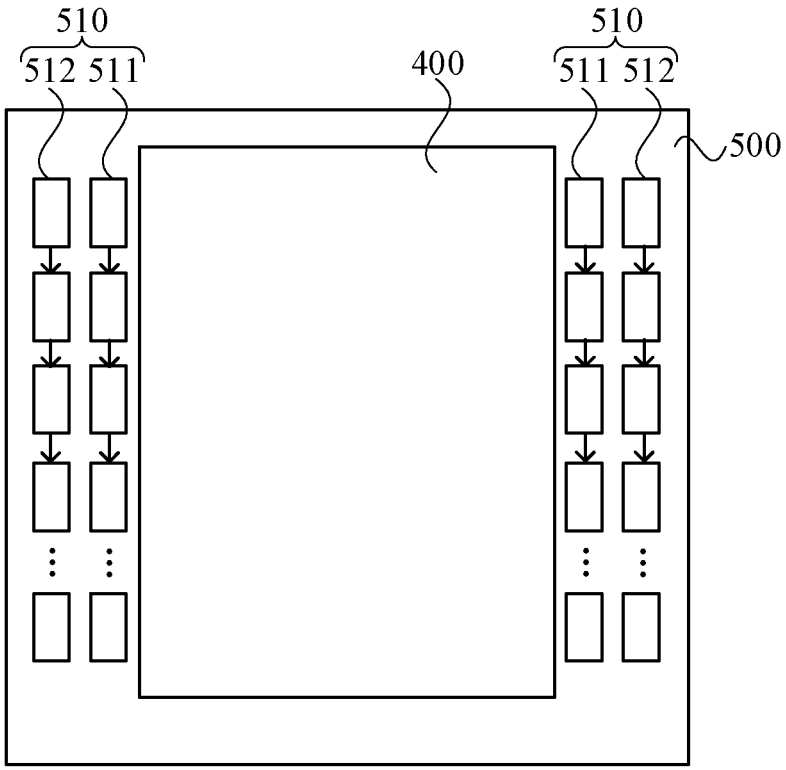
FIG. 12 is a diagram illustrating the structure of an array substrate according to an embodiment of the present disclosure.

FIG. 12 is a diagram illustrating the structure of an array substrate according to an embodiment of the present disclosure. Referring to FIG. 12, optionally, the array substrate includes a display region 400 and a bezel region 500 surrounding the display region. The display region 400 includes multiple pixel circuits arranged in an array (not shown in FIG. 12). The bezel region 500 includes a shift register circuit 510. The shift register circuit 510 includes multiple cascaded first shift registers 511 and multiple cascaded second shift registers 512. The output terminal of a first shift register 511 is a scanning signal terminal S (not shown in FIG. 12). The output terminal of a second shift register 512 is an enable signal terminal Emit (not shown in FIG. 12).

Each of the first shift register 511 and the second shift register 512 is a shift register including multiple transistors and capacitors. The first shift register 511 and the second shift register 512 are configured to provide the control signal required by the gates of the transistors in the pixel circuit to control the corresponding transistors to turn on or off. The specific circuit structure may be selected according to actual situations. This is not limited in this embodiment of the present disclosure. It is merely schematic that the first shift register 511 is located on the side of the second shift register 512 adjacent to the display region 400. The order of the two is not limited in this embodiment of the present disclosure. In this embodiment, it is schematically shown that the shift register circuit 510 is located at the left and right bezels of the array substrate. In other embodiments, the shift register circuit 510 may also be disposed in only one bezel, or the first shift register 511 and the second shift register 512 may be located in different bezels respectively.

In this embodiment of the present disclosure, the provided pixel circuit includes two scanning signal lines (such as the first scanning signal line S1 and the second scanning signal line S1' in FIG. 10) and two enable signal lines (such as the first enable signal line Emit1 and the second enable signal line Emit1' in FIG. 10). In this embodiment, the output terminal of the first shift register 511 is divided into two, and the two are connected to the two scanning signal lines separately. The output end of the second shift register 512 is divided into two, and the two are connected to the two enable signal lines separately. During specific implementation, the same first shift register 511 may be connected to two scanning signal lines of the pixel circuit in the same row or to two scanning signal lines of the pixel circuit in a different row. The same second shift register 512 may be connected to two enable signal lines of the pixel circuit in the same row or to two enable signal lines of the pixel circuit in a different row.

Optionally, the array substrate includes n rows of pixel circuits. Pixel circuits in each row are connected through a first scanning signal line and a second scanning signal line. The output terminal of the first shift register at the i-th stage is connected to each of the first scanning signal line and the second scanning signal line in the pixel circuits in the i-th row. $0<i\leq n$, $n\geq 2$, and i and n are the integers.

Optionally, the array substrate includes n rows of pixel circuits. Pixel circuits in each row are connected through a first scanning signal line and a second scanning signal line. The output terminal of the first shift register at the i-th stage is connected to each of the second scanning signal line in the pixel circuits in the i-th row and the first scanning signal line in the pixel circuits in the (i+j)-th row. $0<i\leq n$, $0<j\leq n-i$, $n\geq 3$, and i, j, and n are integers.

Optionally, pixel circuits in each row are connected through a first enable signal line and a second enable signal line. The output terminal of the second shift register at the i-th stage is connected to each of the first enable signal line and the second enable signal line in the pixel circuits in the i-th row. $0<i\leq n$, $n\geq 2$, and i and n are integers.

Optionally, pixel circuits in each row are connected through a first enable signal line and a second enable signal line. The output terminal of the second shift register at the i-th stage is connected to each of the first enable signal line in the pixel circuits in the i-th row and the second enable signal line in the pixel circuits in the (i+j)-th row. $0<i\leq n$, $0<j\leq n-i$, $n\geq 3$, and i, j, and n are integers.

Figure 13:
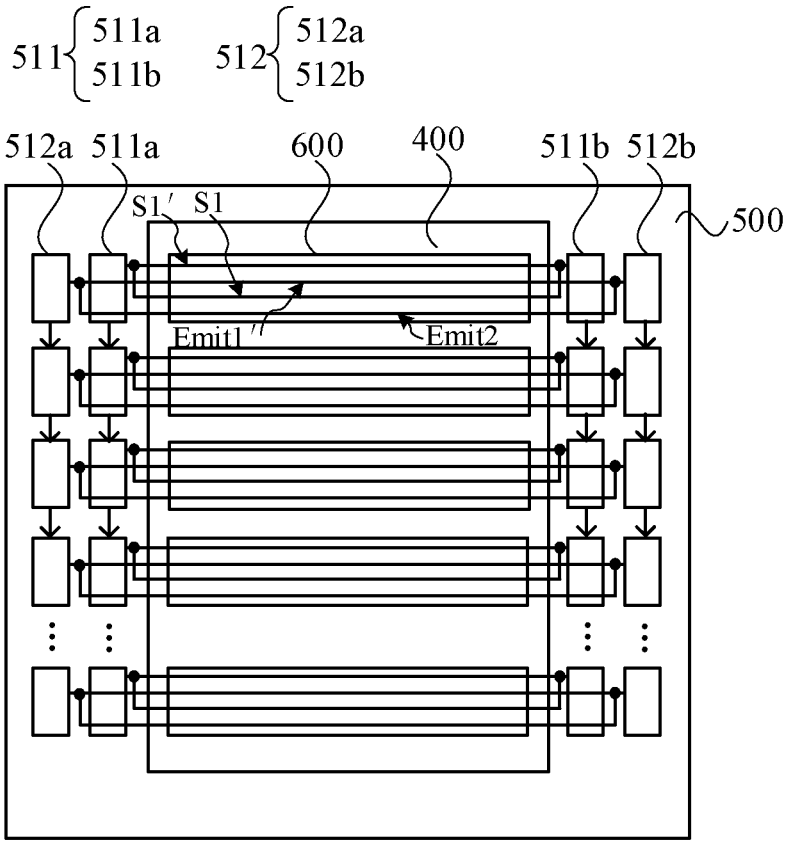
FIGS. 13 to 16 are diagrams illustrating the structure of another array substrate according to embodiments of the present disclosure.

For example, FIGS. 13 to 16 are diagrams illustrating the structure of another array substrate according to embodiments of the present disclosure. Referring to FIGS. 13 to 16, the array substrate includes n rows of pixel circuits 600. Pixel circuits in each row are connected through a first scanning signal line S1, a second scanning signal line S1', a first enable signal line Emit1, and a second enable signal line Emit1'. The first shift register 511 includes a first sub-shift register 511*a* and a second sub-shift register 511*b*. The second shift register 512 includes a third sub-shift register 512*a* and a fourth sub-shift register 512*b*. Referring to FIG. 13, the first scanning signal line S1 and the second scanning signal line S1' of the pixel circuits in each row are connected to the first sub-shift register 511*a* and the second sub-shift register 511*b* in the corresponding row, that is, the first-stage first sub-shift register 511*a* and the first-stage second sub-shift register 511*b* are connected to the first scanning signal line S1 and the second scanning signal line S1' in the pixel circuits in the first row, and the second-stage first sub-shift register 511*a* and the second-stage second sub-shift register 511*b* are connected to the first scanning signal line S1 and the second scanning signal line S1' in the pixel circuits in the second row. The rest are done in the same manner. The nth-stage first sub-shift register 511*a* and the nth-stage second sub-shift register 511*b* are connected to the first scanning signal line S1 and the second scanning signal line S1' in the pixel circuits in the nth row. The first enable signal line Emit1 and the second enable signal line Emit1' of the pixel circuits in each row are connected to the third sub-shift register 512*a* and the fourth sub-shift register 512*b* in the corresponding row, that is, the first-stage third sub-shift register 512*a* and the first-stage fourth sub-shift register 512*b* are connected to the first enable signal line Emit1 and the second enable signal line Emit1' in the pixel circuits in the first row, the second-stage third sub-shift register 512*a* and the second-stage fourth sub-shift register 512*b* are connected to the first enable signal line Emit1 and the second enable signal line Emit1' in the pixel circuits in the second row, and the third-stage third sub-shift register 512*a* and the third-stage fourth sub-shift register 512*b* are connected to the first enable signal line Emit1 and the second enable signal line Emit1' in the pixel circuits in the third row. The rest are done in the same manner. The nth-stage third sub-shift register 512*a* and the nth-stage fourth sub-shift register 512*b* are connected to the first enable signal line Emit1 and the second enable signal line Emit1' in the pixel circuits in the nth row.

Figure 14:
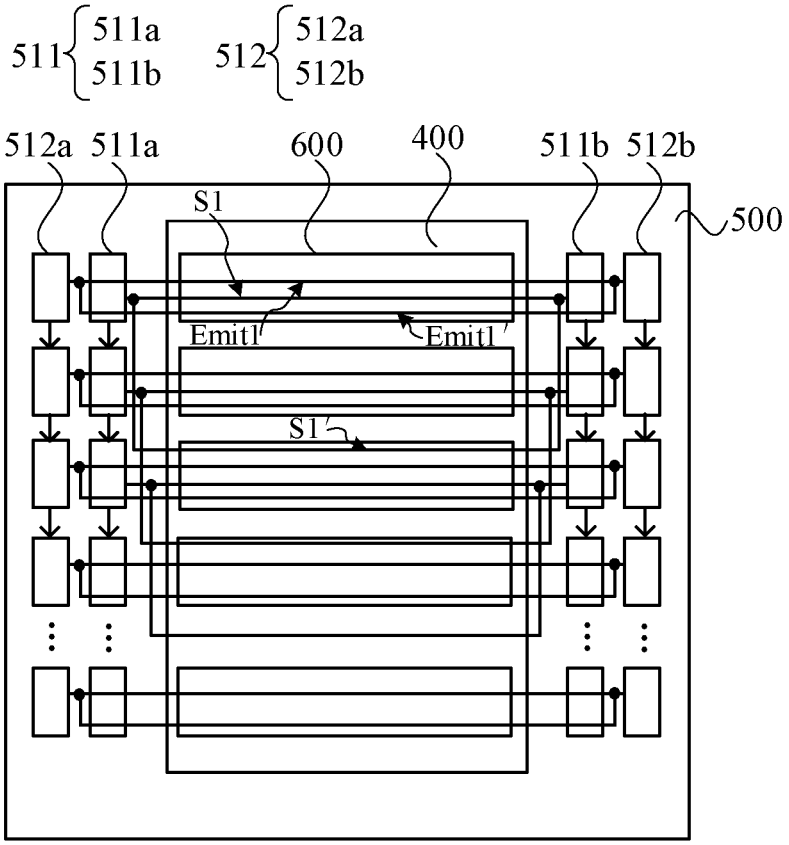

Referring to FIG. 14, a case in which j=2 is used as an example. The first-stage first sub-shift register 511*a* and the first-stage second sub-shift register 511*b* are connected to the first scanning signal line S1 in the pixel circuits in the first row and the second scanning signal line S1' in the pixel circuits in the third row. The second-stage first sub-shift register 511*a* and the second-stage second sub-shift register 511*b* are connected to the first scanning signal line S1 in the pixel circuits in the second row and the second scanning signal line S1' in the pixel circuits in the fourth row. The rest are done in the same manner. It is to be noted that the control signal of the second scanning signal line S1' in the pixel circuits in the first row may be provided by a redundant shift register disposed before the first-stage first sub-shift register 511*a*. Part of connection lines are not shown in the figure. The scanning signals of the two scanning signal lines in the pixel circuits in the same row are the same. During specific implementation, the value of j may be designed according to the actual situations so that the timing of the control signal of the second scanning signal line S1' is the same as the timing of the control signal of the first scanning signal line S1, that is, the control signal of the second scanning signal line S1' is a signal, after being shifted by j stages, having the same timing sequence as the first scanning signal line S1. The first enable signal line Emit1 and the second enable signal line Emit1' are connected in the same manner as in FIG. 13, and the details are not repeated here.

Figure 15:
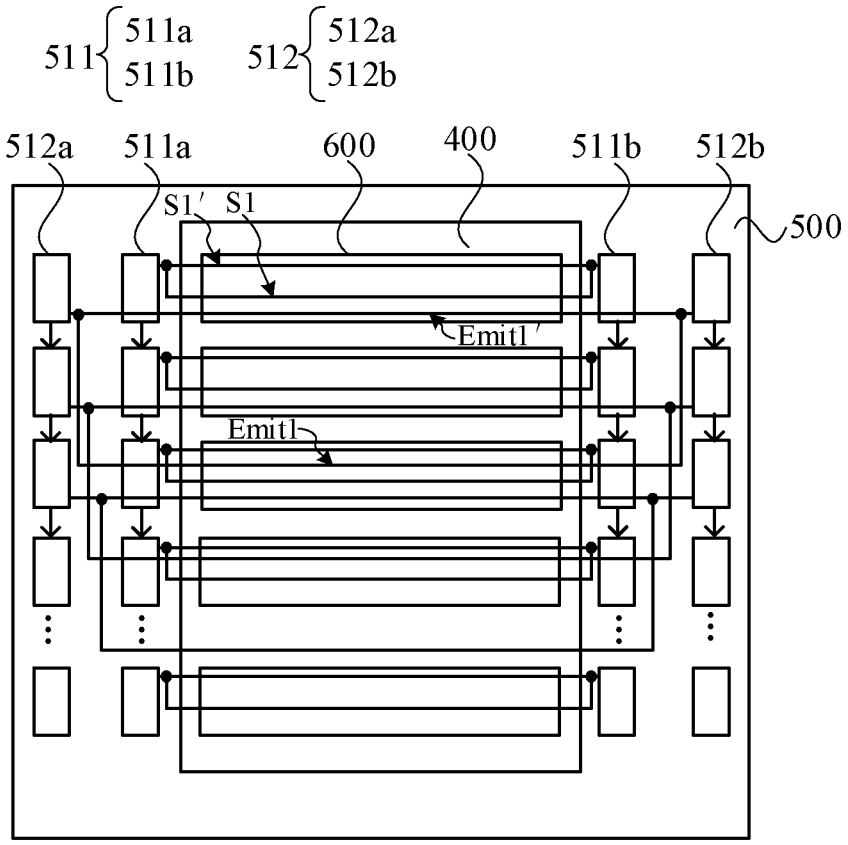

Referring to FIG. 15, a case in which j=2 is used as an example. The first-stage third sub-shift register 512*a* and the first-stage fourth sub-shift register 512*b* are connected to the second enable signal line Emit1' in the pixel circuits in the first row and the first enable signal line Emit1 in the pixel circuits in the third row. The second-stage third sub-shift register 512*a* and the second-stage fourth sub-shift register 512*b* are connected to the second enable signal line Emit1' in the pixel circuits in the second row and the first enable signal line Emit1 in the pixel circuits in the fourth row. The rest are done in the same manner. It is to be noted that the control signal of the first enable signal line Emit1 in the pixel circuits in the first row may be provided by a redundant shift register disposed before the first-stage third sub-shift register 512*a*. Part of connection lines are not shown in the figure. The first scanning signal line S1 and the second scanning signal line S1' are connected in the same manner as in FIG. 13, and the details are not repeated here.

Figure 16:
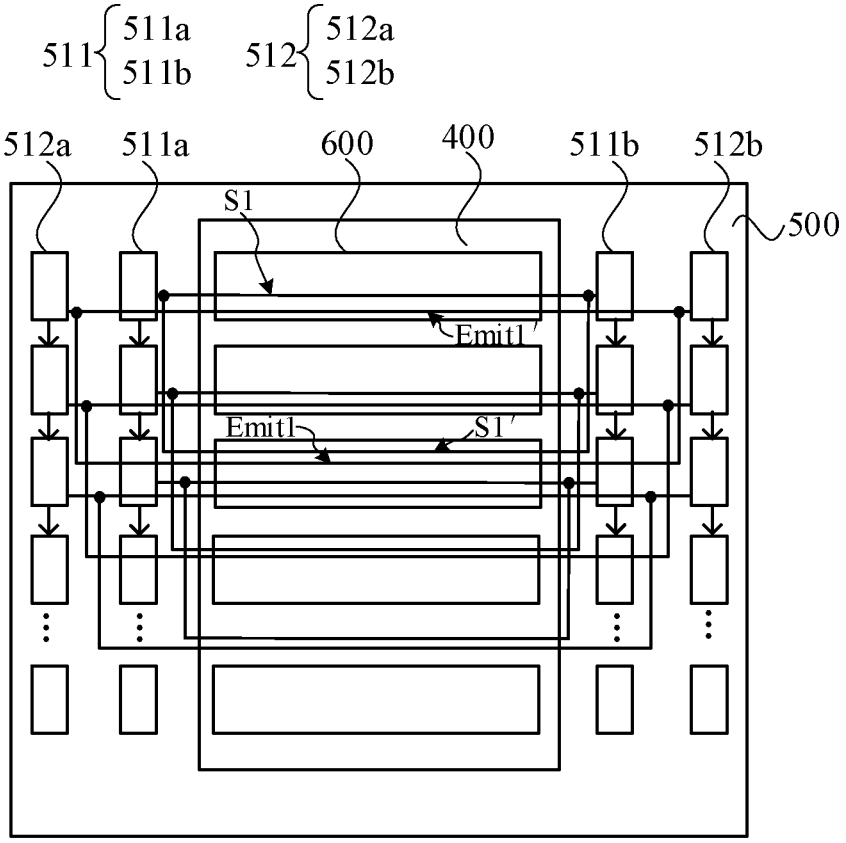

Referring to FIG. 16, a case in which j=2 is still used as an example. The first scanning signal line S1 and the second scanning signal line S1' are connected in the same manner as in FIG. 14. The first enable signal line Emit1 and the second enable signal line Emit1' are connected in the same manner as in FIG. 15.

It is to be noted that the array substrate provided by this embodiment of the present disclosure may adopt a single-sided driving method or a double-sided driving method when driving the pixel circuit. For example, when scanning signal lines are driven, a first sub-shift register and a second sub-shift register provide signals to the corresponding scanning signal lines from two sides at the same time, which is the double-sided drive. The first sub-shift register provides a signal to one of the scanning signal lines from the left side while the second sub-shift register provides a signal to the other scanning signal line from the right side, which is the single-sided drive. The method for driving a signal is not limited in this embodiment of the present disclosure.

An embodiment of the present disclosure provides a display panel. The display panel includes any array substrate provided by the preceding embodiments. The display panel has the technical effect of a narrow bezel.

Figure 17:
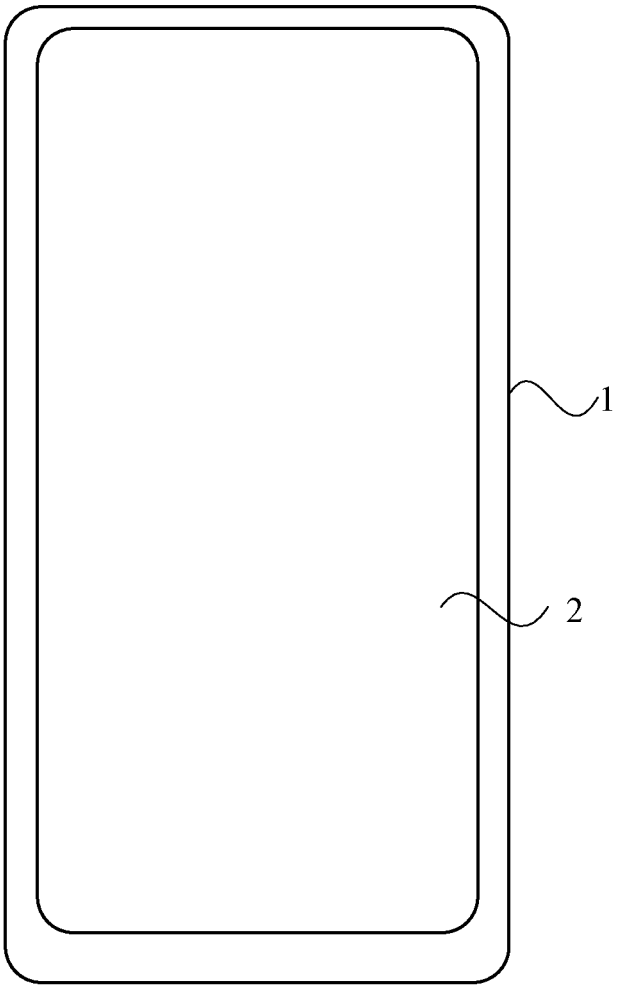
FIG. 17 is a view illustrating the structure of a display device according to an embodiment of the present disclosure.

FIG. 17 is a view illustrating the structure of a display device according to an embodiment of the present disclosure. Referring to FIG. 17, the display device 1 includes any display panel 2 provided in the embodiments of the present disclosure. The display device 1 may be a mobile phone, a computer, and a smart wearable device.

It is to be noted that the preceding are only preferred embodiments of the present disclosure and the technical principles used therein. It is to be understood by those skilled in the art that the present disclosure is not limited to the embodiments described herein. For those skilled in the art, various apparent modifications, adaptations, combinations, and substitutions can be made without departing from the scope of the present disclosure. Therefore, while the present disclosure is described in detail in connection with the preceding embodiments, the present disclosure is not limited to the preceding embodiments and may include equivalent embodiments without departing from the concept of the present disclosure. The scope of the present disclosure is determined by the scope of the appended claims.

What is claimed is:

1. A pixel circuit, comprising:

a drive circuit, wherein a control terminal of the drive circuit is electrically connected to a first node, a first terminal of the drive circuit is electrically connected to a second node, and a second terminal of the drive circuit is electrically connected to a third node;

a first initialization circuit, wherein a first terminal of the first initialization circuit is electrically connected to a first reference signal terminal, and a second terminal of the first initialization circuit is electrically connected to the third node;

a data write circuit, wherein a control terminal of the data write circuit is electrically connected to a scanning signal terminal, a first terminal of the data write circuit is electrically connected to a data signal terminal, and a second terminal of the data write circuit is electrically connected to the second node; and a threshold compensation circuit, wherein a control terminal of the threshold compensation circuit is electrically connected to an enable signal terminal, a first terminal of the threshold compensation circuit is electrically connected to the third node, and a second terminal of the threshold compensation circuit is electrically connected to the first node.

2. The pixel circuit according to claim 1, wherein the first initialization circuit comprises a first n-type transistor and a second n-type transistor;

wherein a control terminal of the first n-type transistor is electrically connected to the scanning signal terminal, a first terminal of the first n-type transistor is electrically connected to the first reference signal terminal, a second terminal of the first n-type transistor is electrically connected to a first terminal of the second n-type transistor;

wherein a control terminal of the second n-type transistor is electrically connected to the enable signal terminal, and a second terminal of the second n-type transistor is electrically connected to the third node; and wherein the threshold compensation circuit comprises a third n-type transistor, a control terminal of the third n-type transistor is electrically connected to the enable signal terminal, a first terminal of the third n-type transistor is electrically connected to the third node, and a second terminal of the third n-type transistor is electrically connected to the first node.

3. The pixel circuit according to claim 2, wherein each of the first n-type transistor, the second n-type transistor, and the third n-type transistor is a transistor comprising an oxide semiconductor.

4. The pixel circuit according to claim 2, further comprising:

a storage circuit, wherein a first terminal of the storage circuit is electrically connected to a first power voltage terminal, and a second terminal of the storage circuit is electrically connected to the first node;

a second initialization circuit, wherein a control terminal of the second initialization circuit is electrically connected to the scanning signal terminal, a first terminal of the second initialization circuit is electrically connected to a second reference signal terminal, and a second terminal of the second initialization circuit is electrically connected to a first electrode of a light-emitting element;

a first light emission control circuit, wherein a control terminal of the first light emission control circuit is electrically connected to the enable signal terminal, a first terminal of the first light emission control circuit is electrically connected to the first power voltage terminal, and a second terminal of the first light emission control circuit is electrically connected to the first terminal of the drive circuit; and/or a second light emission control circuit, wherein a control terminal of the second light emission control circuit is electrically connected to the enable signal terminal, and a first terminal of the second light emission control circuit is electrically connected to the second terminal of the drive circuit, a second terminal of the second light emission control circuit is electrically connected to the first electrode of the light-emitting element, and a second electrode of the light-emitting element is electrically connected to a second power voltage terminal.

5. The pixel circuit according to claim 4, wherein the drive circuit comprises a drive transistor, the data write circuit comprises a fourth transistor, the first light emission control circuit comprises a fifth transistor, the second light emission control circuit comprises a sixth transistor, the second initialization circuit comprises a seventh transistor, and the storage circuit comprises a first capacitor;

wherein a control terminal of the fifth transistor is electrically connected to the enable signal terminal, a first terminal of the fifth transistor is electrically connected to the first power voltage terminal, and a second terminal of the fifth transistor is electrically connected to a first terminal of the drive transistor;

wherein a control terminal of the drive circuit is electrically connected to the first node, and a second terminal of the drive transistor is electrically connected to a first terminal of the sixth transistor;

wherein a control terminal of the fourth transistor is electrically connected to the scanning signal terminal, a first terminal of the fourth transistor is electrically connected to the data signal terminal, and a second terminal of the fourth transistor is electrically connected to the first terminal of the drive transistor;

wherein a control terminal of the sixth transistor is electrically connected to the enable signal terminal, and a second terminal of the sixth transistor is electrically connected to the first electrode of the light-emitting element;

wherein a control terminal of the seventh transistor is electrically connected to the scanning signal terminal, a first terminal of the seventh transistor is electrically connected to the second reference signal terminal, and a second terminal of the seventh transistor is electrically connected to the first electrode of the light-emitting element; and wherein a first terminal of the first capacitor is electrically connected to the first node, and a second terminal of the first capacitor is electrically connected to the first power voltage terminal.

6. The pixel circuit according to claim 5, wherein each of the drive transistor, the fourth transistor, the fifth transistor, the sixth transistor, and the seventh transistor is a p-type transistor.

7. The pixel circuit according to claim 6, wherein the p-type transistor is a transistor comprising a low-temperature polycrystalline silicon semiconductor.

8. A driving method of a pixel circuit, the method being used for driving a pixel circuit and the pixel circuit comprises:

a drive circuit, wherein a control terminal of the drive circuit is electrically connected to a first node, a first terminal of the drive circuit is electrically connected to a second node, and a second terminal of the drive circuit is electrically connected to a third node;

a first initialization circuit, wherein a first terminal of the first initialization circuit is electrically connected to a first reference signal terminal, and a second terminal of the first initialization circuit is electrically connected to the third node;

a data write circuit, wherein a control terminal of the data write circuit is electrically connected to a scanning signal terminal, a first terminal of the data write circuit is electrically connected to a data signal terminal, and a second terminal of the data write circuit is electrically connected to the second node; and a threshold compensation circuit, wherein a control terminal of the threshold compensation circuit is electrically connected to an enable signal terminal, a first terminal of the threshold compensation circuit is electrically connected to the third node, and a second terminal of the threshold compensation circuit is electrically connected to the first node; and wherein the method comprises:

in an initialization stage, controlling the first initialization circuit and the threshold compensation circuit to turn on, controlling the data write circuit and the drive circuit to turn off, and initializing a potential of the first node by the first initialization circuit;

in a data write stage, controlling the data write circuit, the drive circuit, and the threshold compensation circuit to turn on, controlling the first initialization circuit to turn off, and writing a data signal to the first node by the data write circuit; and in a light emission stage, controlling the drive circuit to turn on, controlling the data write circuit, the first initialization circuit, and the threshold compensation circuit to turn off, providing a drive current to a light-emitting element by the drive circuit, and emitting light by the light-emitting element in response to the drive current.

9. The driving method according to claim 8, wherein the first initialization circuit comprises a first n-type transistor and a second n-type transistor;

wherein a control terminal of the first n-type transistor is electrically connected to the scanning signal terminal, a control terminal of the second n-type transistor is electrically connected to the enable signal terminal;

wherein the driving method further comprises:

in the initialization stage, controlling the first n-type transistor to turn on by a control signal output by the scanning signal terminal and controlling the second n-type transistor to turn on by a control signal output by the enable signal terminal so that the first initialization circuit is turned on;

in the data write stage, controlling the first n-type transistor to turn off through the control signal output by the scanning signal terminal and controlling the second n-type transistor to turn on through the control signal output by the enable signal terminal so that the first initialization circuit is turned off; and in the light emission stage, controlling the first n-type transistor to turn on through the control signal output by the scanning signal terminal and controlling the second n-type transistor to turn off through the control signal output by the enable signal terminal so that the first initialization circuit is turned off.

10. The driving method according to claim 9, wherein the control terminal of the data write circuit is electrically connected to the scanning signal terminal, the data write circuit is controlled to turn on in the data write stage and turn off in the initialization stage and the light emission stage through the control signal output by the scanning signal terminal.

11. The driving method according to claim 10, wherein the pixel circuit further comprises the threshold compensation circuit, the drive circuit comprises a drive transistor, and the driving method further comprises:

in the data write stage, controlling the data write circuit, the drive circuit, and the threshold compensation circuit to turn on, controlling the first initialization circuit to turn off, writing a data signal to the first node by the data write circuit, and performing threshold compensation on the drive transistor, wherein the threshold compensation circuit comprises a third n-type transistor, a control terminal of the third n-type transistor is electrically connected to the enable signal terminal, and the third n-type transistor is controlled to turn on in the initialization stage and the data write stage and turn off in the light emission stage through an output signal of the enable signal terminal.

12. The driving method according to claim 8, wherein the pixel circuit further comprises a second initialization circuit, a first light emission control circuit, and/or a second light emission control circuit, and the driving method further comprises:

in the data write stage, controlling the second initialization circuit to turn on, and initializing a potential of a first electrode of a light-emitting element by the second initialization circuit; and in the light emission stage, controlling the first light emission control circuit and the second light emission control circuit to turn on.

13. The driving method according to claim 12, wherein a control terminal of the second initialization circuit is electrically connected to the scanning signal terminal, and a control terminal of the first light emission control circuit and a control terminal of the second light emission control circuit are each connected to the enable signal terminal;

the second initialization circuit is controlled to turn on in the data write stage and turn off in the initialization stage and the light emission stage through an output signal of the scanning signal terminal; and the first light emission control circuit and the second light emission control circuit are controlled to turn on in the light emission stage and turn off in the initialization stage and the data write stage through an output signal of the enable signal terminal.

14. A display panel, comprising a display region, wherein the display region comprises a plurality of pixel circuits arranged in an array, and each of the plurality of pixel circuits comprises:

a drive circuit, wherein a control terminal of the drive circuit is electrically connected to a first node, a first terminal of the drive circuit is electrically connected to a second node, and a second terminal of the drive circuit is electrically connected to a third node;

a first initialization circuit, wherein a first terminal of the first initialization circuit is electrically connected to a first reference signal terminal, and a second terminal of the first initialization circuit is electrically connected to the third node;

a data write circuit, wherein a control terminal of the data write circuit is electrically connected to a scanning signal terminal, a first terminal of the data write circuit is electrically connected to a data signal terminal, and a second terminal of the data write circuit is electrically connected to the second node; and a threshold compensation circuit, wherein a control terminal of the threshold compensation circuit is electrically connected to an enable signal terminal, a first terminal of the threshold compensation circuit is electrically connected to the third node, and a second terminal of the threshold compensation circuit is electrically connected to the first node.

15. The display panel according to claim 14, wherein the pixel circuit comprises a scanning signal line and an enable signal line extending in a first direction;

wherein the scanning signal line is electrically connected to the scanning signal terminal and configured to transmit a control signal of the scanning signal terminal to the pixel circuit, and the enable signal line is electrically connected to the enable signal terminal and configured to transmit an enable signal of the enable signal terminal to the pixel circuit.

16. The display panel according to claim 15, wherein the scanning signal line comprises a first scanning signal line and a second scanning signal line, and the enable signal line comprises a first enable signal line and a second enable signal line; and the first enable signal line and the second enable signal line are located on both sides of the drive circuit separately, the first scanning signal line is located between the first enable signal line and the drive circuit, and the second scanning signal line is located on one side of the first enable signal line facing away from the drive circuit.

17. The display panel according to claim 16, wherein the pixel circuit further comprises a first semiconductor active layer and a second semiconductor active layer;

wherein the second scanning signal line overlaps the second semiconductor active layer to form a first n-type transistor, and the second scanning signal line overlaps the first semiconductor active layer to form a seventh transistor;

wherein the first enable signal line overlaps the second semiconductor active layer to form a second n-type transistor and a third n-type transistor;

wherein the first scanning signal line overlaps the first semiconductor active layer to form a fourth transistor; and wherein the second enable signal line overlaps the first semiconductor active layer to form a fifth transistor and a sixth transistor.

18. The display panel according to claim 17, wherein the first semiconductor active layer comprises a low-temperature polycrystalline silicon active layer, and the second semiconductor active layer comprises an oxide semiconductor active layer.

19. The display panel according to claim 17, wherein the pixel circuit further comprises a data signal line and a first power voltage signal line extending in a second direction;

wherein the data signal line is electrically connected to a first terminal of the fourth transistor, the first power voltage signal line is electrically connected to a first terminal of the fifth transistor, and the second direction intersects the first direction.

20. The display panel according to claim 19, wherein the first semiconductor active layer is electrically connected to the second semiconductor active layer through a metal wire, and the metal wire is on a same layer as the data signal line or the first power voltage signal line.

21. The display panel according to claim 15, wherein the pixel circuit comprises a first pixel circuit and a second pixel circuit;

wherein the first pixel circuit and the second pixel circuit share a same power voltage signal line, and the first pixel circuit and the second pixel circuit are symmetrically disposed about the power voltage signal line.

22. The display panel according to claim 15, further comprising a bezel region surrounding the display region, wherein the bezel region comprises a shift register circuit, and the shift register circuit comprises a plurality of cascaded first shift registers and a plurality of cascaded second shift registers;

wherein an output terminal of one of the plurality of first shift registers is a scanning signal terminal, and an output terminal of one of the plurality of second shift registers is an enable signal terminal.

23. The display panel according to claim 22, comprising n rows of pixel circuits, pixel circuits in each row of the n rows of pixel circuits are connected through a first scanning signal line and a second scanning signal line; and an output terminal of a first shift register at an i-th stage of the plurality of cascaded first shift registers is connected to each of a first scanning signal line and a second scanning signal line in pixel circuits in an i-th row of the n rows of pixel circuits, wherein $0<i\leq n$, $n\geq 2$, and i and n are integers.

24. The display panel according to claim 23, wherein the pixel circuits in each row are connected through a first enable signal line and a second enable signal line; and an output terminal of a second shift register at an i-th stage of the plurality of cascaded second shift registers is connected to each of a first enable signal line and a second enable signal line in the pixel circuits in the i-th row, wherein $0<i\leq n$, $n\geq 2$, and i and n are the integers.

25. The display panel according to claim 23, wherein the pixel circuits in each row are connected through a first enable signal line and a second enable signal line; and an output terminal of a second shift register at an i-th stage of the plurality of cascaded second shift registers is connected to each of a first enable signal line in the pixel circuits in the i-th row and a second enable signal line in the pixel circuits in the (i+j)-th row, wherein $0<i\leq n$, $0<j\leq n-i$, $n\geq 3$, and i, j, and n are the integers.

26. The display panel according to claim 22, comprising n rows of pixel circuits, pixel circuits in each row of the n rows of pixel circuits are connected through a first scanning signal line and a second scanning signal line; and an output terminal of a first shift register at an i-th stage of the plurality of cascaded first shift registers is connected to each of a second scanning signal line in pixel circuits in an i-th row of the n rows of pixel circuits and a first scanning signal line in pixel circuits in an (i+j)-th row of the n rows of pixel circuits, wherein $0<i\leq n$, $0<j\leq n-i$, $n\geq 3$, and i, j, and n are integers.

* * * * *